US009613579B2

(12) United States Patent
Jung et al.

(10) Patent No.: US 9,613,579 B2
(45) Date of Patent: Apr. 4, 2017

(54) LIQUID CRYSTAL DISPLAY

(71) Applicant: SAMSUNG DISPLAY CO., LTD., Yongin, Gyeonggi-Do (KR)

(72) Inventors: Jae Hoon Jung, Anyang-si (KR); Hyo Sik Kim, Yongin-si (KR); Ki Chul Shin, Seongnam-si (KR); Dan Bi Yang, Gunpo-si (KR); Ji Phyo Hong, Pyeongtaek-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 105 days.

(21) Appl. No.: 14/721,963

(22) Filed: May 26, 2015

(65) Prior Publication Data

US 2015/0371592 A1 Dec. 24, 2015

(30) Foreign Application Priority Data

Jun. 20, 2014 (KR) ..... 10-2014-0076073

(51) Int. Cl.
*G09G 3/28* (2013.01)
*G09G 3/36* (2006.01)

(52) U.S. Cl.
CPC ..... *G09G 3/3659* (2013.01); *G09G 3/3648* (2013.01); *G09G 2300/0426* (2013.01); *G09G 2300/0447* (2013.01)

(58) Field of Classification Search
CPC ..... G09G 3/3659; G09G 3/3648; G09G 2300/0426; G09G 2300/0447
See application file for complete search history.

(56) References Cited

U.S. PATENT DOCUMENTS 8,189,160 B2 * 5/2012 Kim ..... G02F 1/133707 349/143
8,253,908 B2 * 8/2012 Jung ..... G02F 1/133753 349/141

(Continued)

FOREIGN PATENT DOCUMENTS

KR 10-2012-0050645 A 5/2012
KR 10-2015-0029804 A 3/2015

OTHER PUBLICATIONS

Ting, Tien-Lun et al., A Novel Coupled Charge-Shared Structure on Polymer Sustained Alignment Mode, IDW/AD 2012, pp. 941-944.

*Primary Examiner* — Peter D McLoone
(74) *Attorney, Agent, or Firm* — Lewis Roca Rothgerber Christie LLP

(57) ABSTRACT

A liquid crystal display including a first substrate, a first sub-pixel electrode on the first substrate and configured to receive a first voltage, a second sub-pixel electrode on the first substrate and configured to receive a second voltage, an insulating layer between the first sub-pixel electrode and the second sub-pixel electrode, a second substrate facing the first substrate, and a common electrode on the second substrate, wherein the first sub-pixel electrode includes a first sub-region below the insulating layer and a second sub-region above the insulating layer, wherein the second sub-region of the first sub-pixel electrode includes a plurality of first branch electrodes, wherein the second sub-pixel electrode is above the insulating layer, and wherein a difference between the first voltage and a common voltage is greater than a difference between the second voltage and the common voltage.

12 Claims, 42 Drawing Sheets

(56) References Cited

U.S. PATENT DOCUMENTS

| | | | | |
|---|---|---|---|---|
| 9,213,205 | B2 * | 12/2015 | Kim | G02F 1/134336 |
| 9,454,045 | B2 * | 9/2016 | Han | G02F 1/134309 |
| 2009/0310075 | A1 * | 12/2009 | Kim | G02F 1/133707<br>349/144 |
| 2011/0317119 | A1 * | 12/2011 | Jung | G02F 1/133753<br>349/143 |
| 2012/0120334 | A1 | 5/2012 | Lee et al. | |
| 2013/0002625 | A1 * | 1/2013 | Liao | G02F 1/134309<br>345/205 |
| 2014/0211142 | A1 * | 7/2014 | Kim | G02F 1/133707<br>349/138 |
| 2015/0070634 | A1 | 3/2015 | Jung et al. | |
| 2015/0116645 | A1 * | 4/2015 | Han | G02F 1/134309<br>349/138 |
| 2016/0055807 | A1 * | 2/2016 | Lee | G02F 1/134336<br>345/205 |
| 2016/0275890 | A1 * | 9/2016 | Ra | G09G 3/3648 |

* cited by examiner

LIQUID CRYSTAL DISPLAY

CROSS-REFERENCE TO RELATED APPLICATION

This application claims priority to and the benefit of Korean Patent Application No. 10-2014-0076073, filed in the Korean Intellectual Property Office on Jun. 20, 2014, the entire content of which is incorporated herein by reference.

BACKGROUND

1. Field

An aspect of the present invention relates to a liquid crystal display.

2. Description of the Related Art

A liquid crystal display, which is one of the flat panel displays most widely used at present, includes two display panels on which electric field generating electrodes such as a pixel electrode and a common electrode are formed, and has a liquid crystal layer inserted therebetween.

The liquid crystal display displays an image by generating an electric field on a liquid crystal layer by applying a voltage to the electric field generating electrodes, determining alignments of liquid crystal molecules of the liquid crystal layer through the generated electric field, and controlling polarization of incident light.

The liquid crystal display further includes switching elements connected to each of the pixel electrodes, and a plurality of signal lines, such as gate lines and data lines, which control the switching elements to apply a voltage to the pixel electrodes.

A liquid crystal display with a vertically aligned mode in which long axes of liquid crystal molecules are arranged to be perpendicular (or normal) to upper and lower display panels in a state in which an electric field is not applied among the liquid crystal displays has a high contrast ratio and easily implements a wide reference viewing angle, thereby gaining the spotlight. Herein, the reference viewing angle refers to a viewing angle in which a contrast ratio is 1:10 or an inter-gray luminance inversion critical angle.

In the case of the liquid crystal display of the vertically aligned mode, in order to make side visibility close to front visibility, a method of dividing one pixel into two subpixels and making transmittance different by applying a different voltage to the two subpixels has been proposed.

However, when the side visibility is close to the front visibility by dividing one pixel into two subpixels and making the transmittance different, luminance is increased at a low gray level or a high gray level, such that it is difficult to represent a gray level at the side, thereby causing the reduction in image quality. Further, when a change of transmittance is unclear according to a change of gray levels, the change of gray levels is not expressed and displaying quality may be deteriorated (e.g., reduced).

When a single pixel is divided into two subpixels, transmittance is reduced due to a gap between the two subpixels.

The above information disclosed in this Background section is only for enhancement of understanding of the background of the invention and therefore it may contain information that does not form the prior art that is already known in this country to a person of ordinary skill in the art.

SUMMARY

An aspect of an embodiment of the present invention is directed toward a liquid crystal display for clarifying a change of transmittance caused by a change of gray levels and reducing (e.g., preventing) deterioration of (e.g., reduction of) transmittance while having lateral visibility approaching (or matching) front visibility.

According to an example embodiment of the present invention, there is provided a liquid crystal display including: a first substrate; a first sub-pixel electrode on the first substrate and configured to receive a first voltage; a second sub-pixel electrode on the first substrate and configured to receive a second voltage; an insulating layer between the first sub-pixel electrode and the second sub-pixel electrode; a second substrate facing the first substrate; and a common electrode on the second substrate, wherein the first sub-pixel electrode includes a first sub-region below the insulating layer and a second sub-region above the insulating layer, wherein the second sub-region of the first sub-pixel electrode includes a plurality of first branch electrodes, wherein the second sub-pixel electrode is above the insulating layer and includes: a third sub-region including a plurality of second branch electrodes extending substantially in parallel with the first branch electrodes, a fourth sub-region coupled to the third sub-region and having a planar form in a planar shape, and a fifth sub-region coupled to the fourth sub-region and including a plurality of third branch electrodes extending substantially in parallel with the first branch electrodes and the second branch electrodes, and wherein a difference between the first voltage and a common voltage is greater than a difference between the second voltage and the common voltage.

In an embodiment, a ratio of an area of the fourth sub-region taken over that of an entire area of the second sub-pixel electrode is about 9% to about 30%.

In an embodiment, a part of the first sub-region of the first sub-pixel electrode overlaps the third sub-region of the second sub-pixel electrode with the insulating layer therebetween.

In an embodiment, the first sub-region of the first sub-pixel electrode and the second sub-region are coupled to each other through a contact opening in the insulating layer.

In an embodiment, the second sub-pixel electrode surrounds the second sub-region of the first sub-pixel electrode, and the fourth sub-region of the second sub-pixel electrode has a planar form including four parallelograms.

In an embodiment, the fourth sub-region of the second sub-pixel electrode includes a cutout on an edge of the fourth sub-region that is near an edge data line of the fourth sub-region.

In an embodiment, the cutout is in a direction that is substantially parallel to the third branch electrode.

In an embodiment, the cutout is substantially parallel to the edge of the fourth sub-region.

In an embodiment, in the cutout, a part of the edge of the fourth sub-region is removed in parallel with the edge of the fourth sub-region.

In an embodiment, the second sub-pixel electrode surrounds the second sub-region of the first sub-pixel electrode, and the fourth sub-region of the second sub-pixel electrode has a planar form including four triangles.

In an embodiment, the fourth sub-region has a form in which an apex of the triangle is on an edge of the second sub-pixel electrode.

In an embodiment, an area in which the first sub-region of the first sub-pixel electrode overlaps the third region of the second sub-pixel electrode is about twice an area of the second sub-region of the first sub-pixel electrode, and a sum of areas of the fourth sub-region and the fifth sub-region of the second sub-pixel electrode is about six times an area of the second sub-region of the first sub-pixel electrode.

The liquid crystal display, according to the example embodiment of the present invention, utilizes the first sub-pixel electrode to which the first voltage is applied and the second sub-pixel electrode to which the second voltage is applied, divides one pixel area into four regions respectively having a different electric field intensity, causes the lateral visibility to approach the front visibility, clarifies the change of transmittance induced by the change of gray levels, and reduces (e.g., prevents) deterioration of (e.g., reduction of) transmittance that may occur in the region between the first sub-pixel electrode and the second sub-pixel electrode.

DETAILED DESCRIPTION

Figure 1:
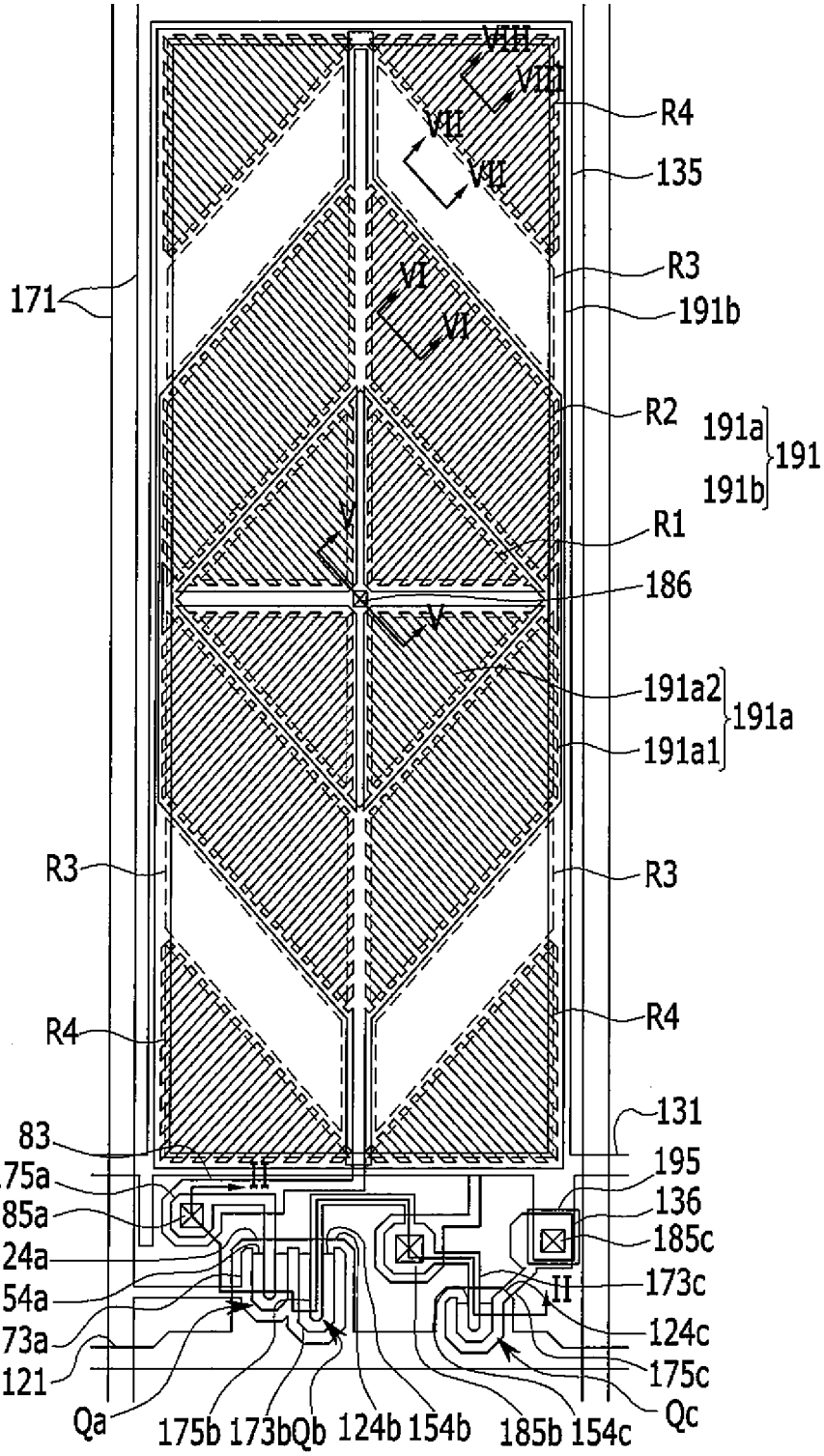
FIG. 1 shows a layout view of a liquid crystal display, according to an example embodiment of the present invention.

Example embodiments of the present invention will be described in more detail with reference to the attached drawings. The present invention may be modified in many different forms, and should not be construed as being limited to the example embodiments set forth herein. Rather, the example embodiments of the present invention are provided so that this disclosure will be thorough and complete, and will fully convey the concept of the present invention to those skilled in the art.

In the drawings, the thickness of layers and regions may be exaggerated for clarity. In addition, when a layer is described to be formed on another layer or on a substrate, this means that the layer may be formed on the other layer or on the substrate, or a third layer may be interposed between the layer and the other layer or the substrate. Like numbers refer to like elements throughout the specification.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. As used herein, the term "substantially," "about," and similar terms are used as terms of approximation and not as terms of degree, and are intended to account for the inherent deviations in measured or calculated values that would be recognized by those of ordinary skill in the art.

Figure 2:
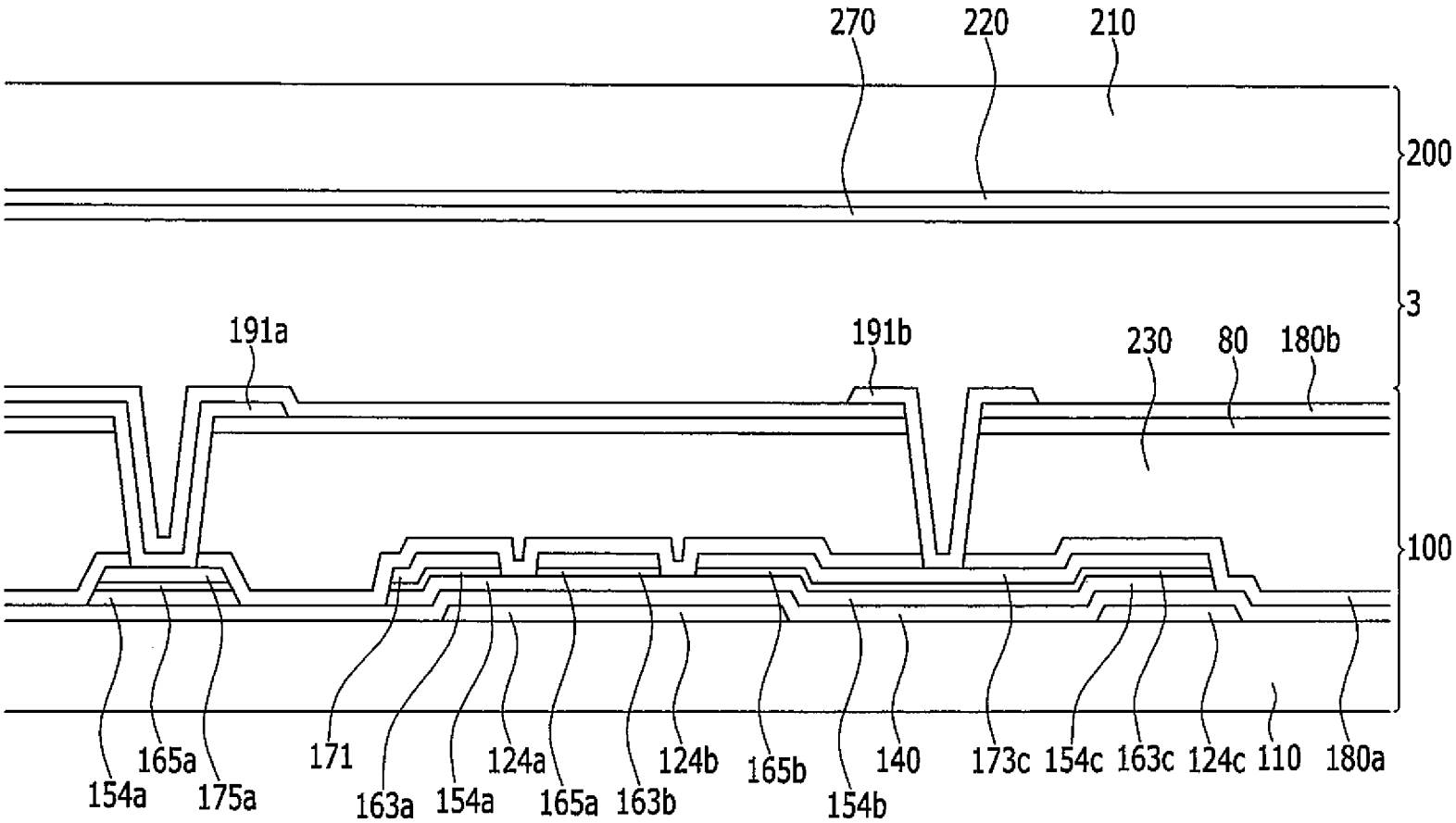
FIG. 2 shows a cross-sectional view of a liquid crystal display of FIG. 1 with respect to the line II-II.
Figure 3:
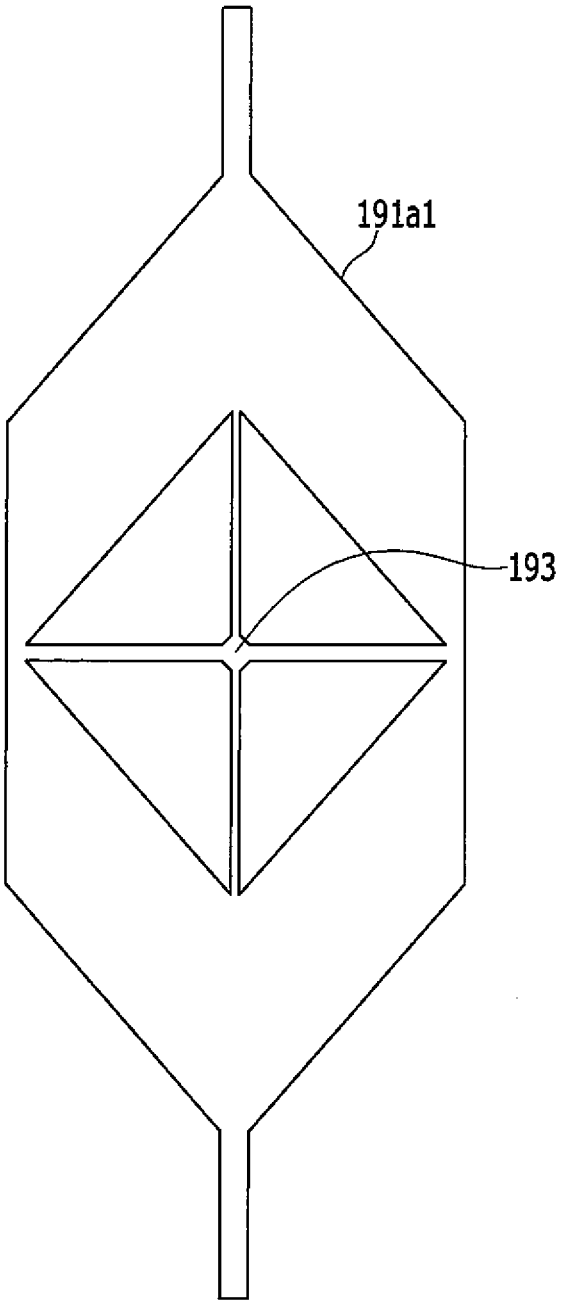
FIG. 3 shows a layout view of a first portion of a first sub-pixel electrode of a liquid crystal display of FIG. 1.
Figure 4:
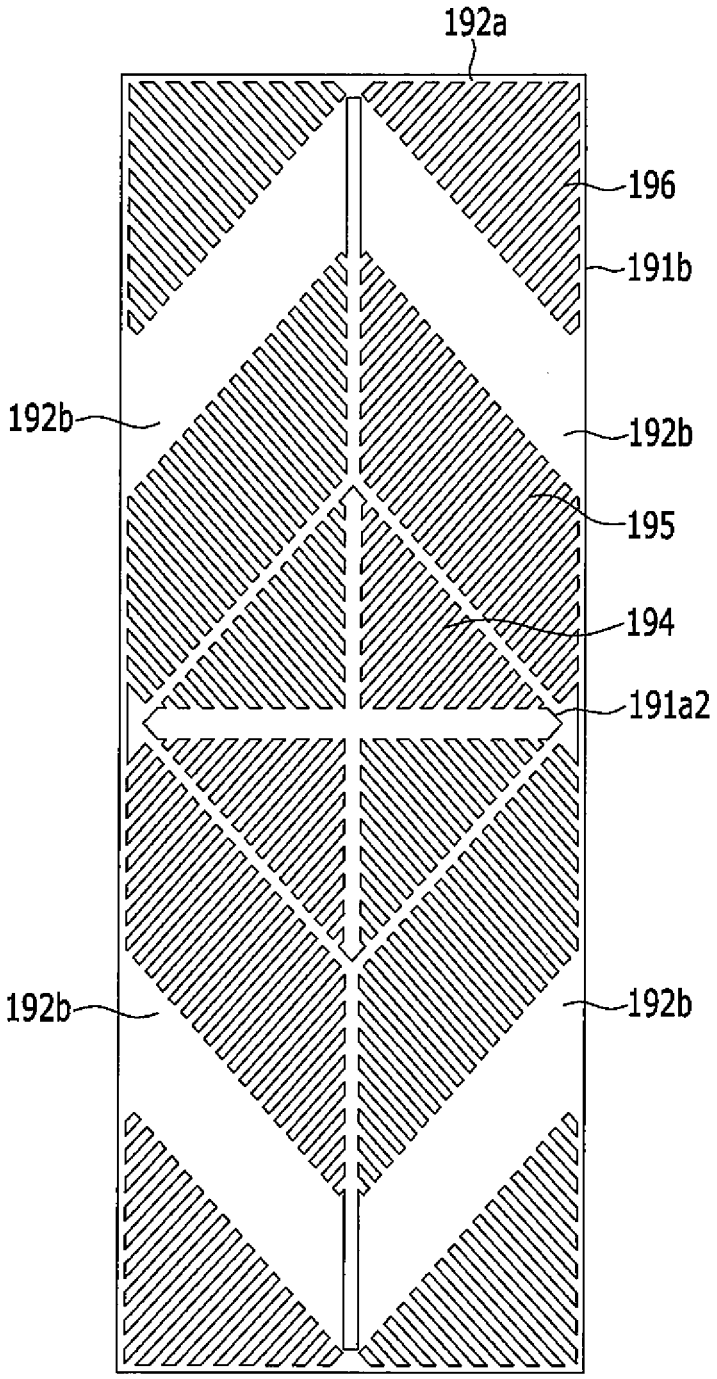
FIG. 4 shows a layout view of a second portion of a first sub-pixel electrode and a second sub-pixel electrode of a liquid crystal display of FIG. 1.
Figure 5:
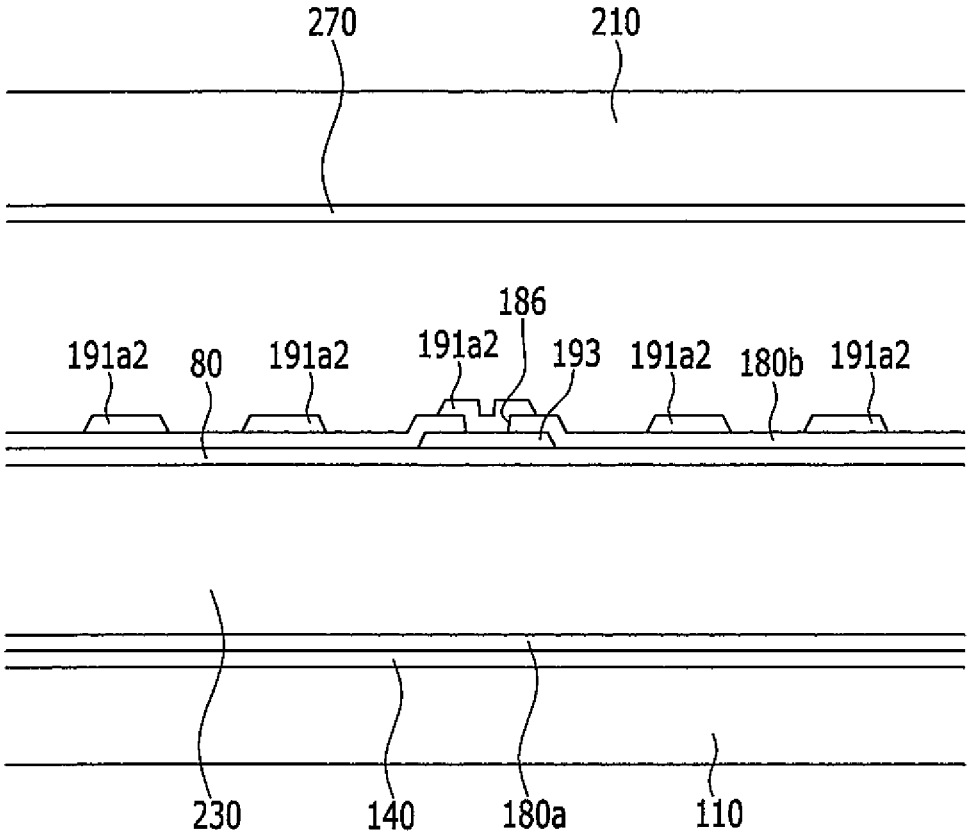
FIG. 5 shows a cross-sectional view of a liquid crystal display of FIG. 1 with respect to the line V-V.
Figure 6:
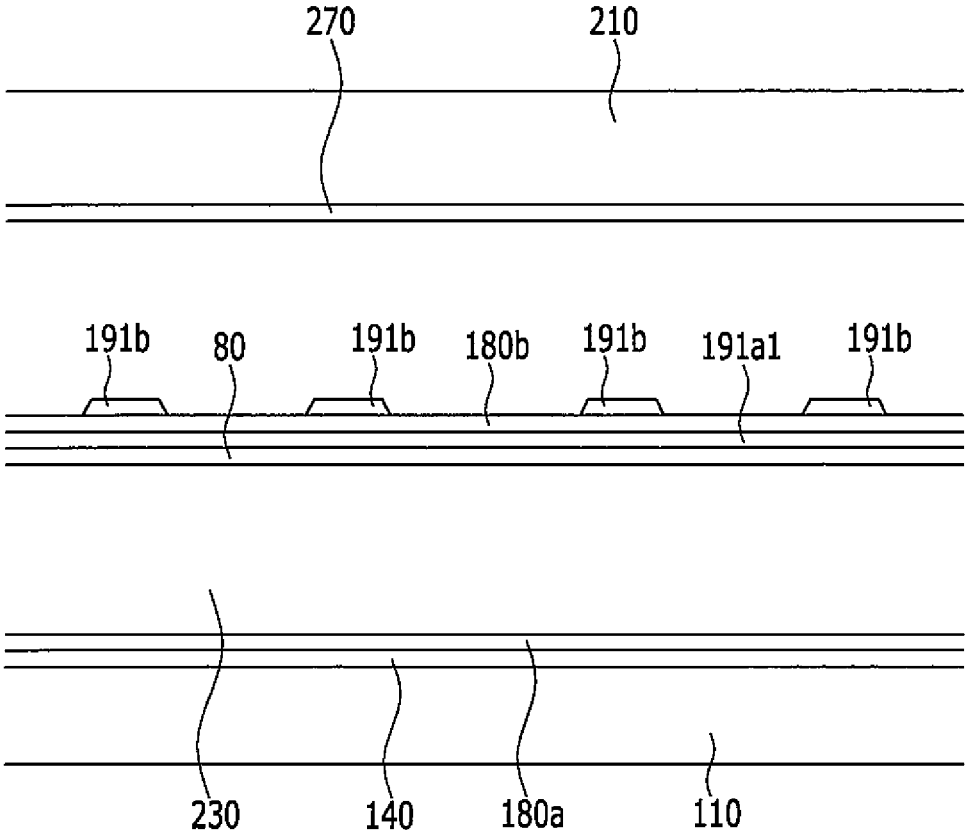
FIG. 6 shows a cross-sectional view of a liquid crystal display of FIG. 1 with respect to the line VI-VI.
Figure 7:
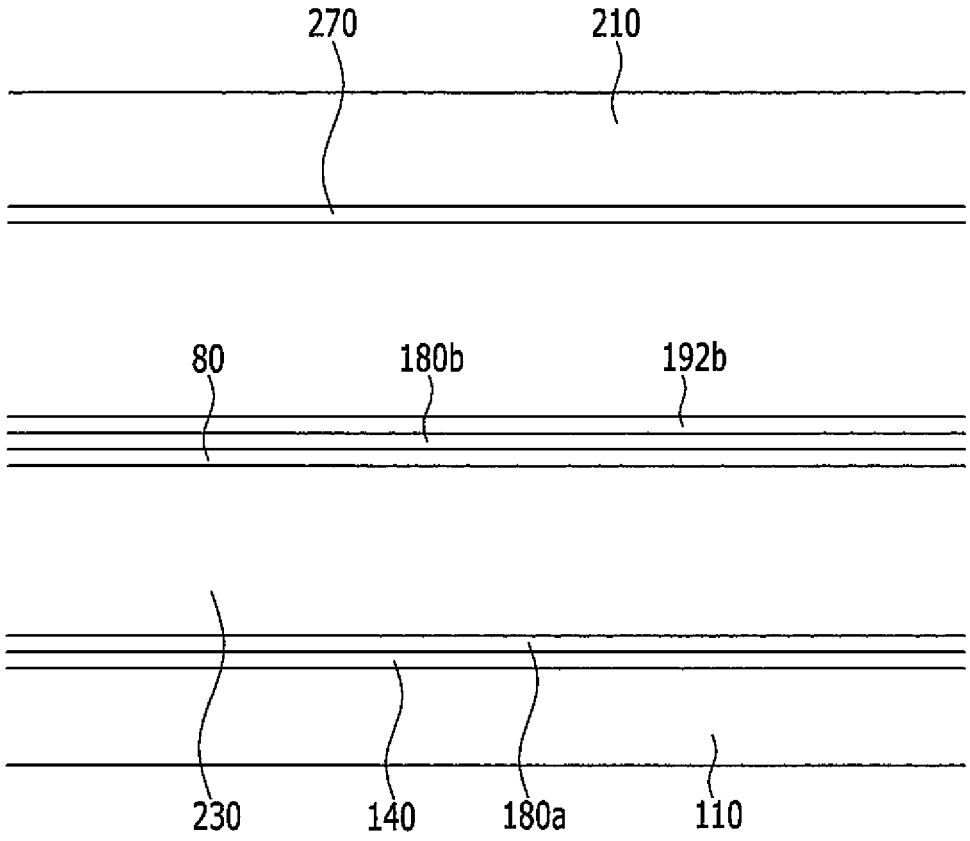
FIG. 7 shows a cross-sectional view of a liquid crystal display of FIG. 1 with respect to the line VII-VII.
Figure 8:
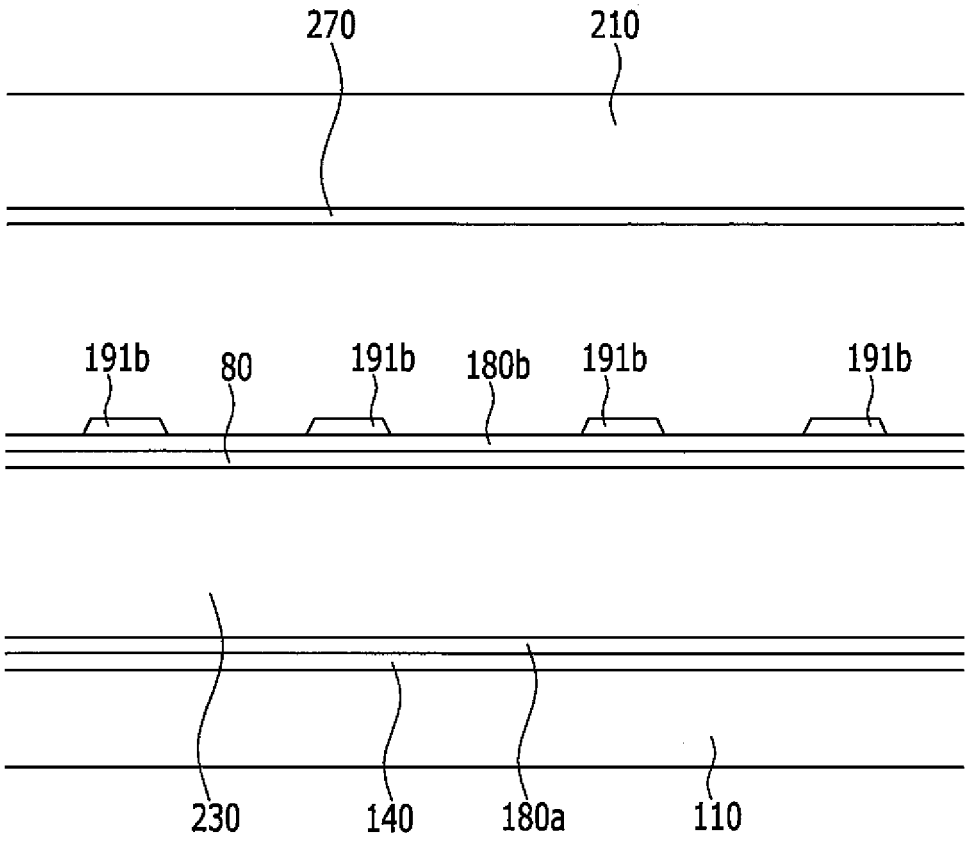
FIG. 8 shows a cross-sectional view of a liquid crystal display of FIG. 1 with respect to the line VIII-VIII.

A liquid crystal display, according to an example embodiment of the present invention, will now be described with reference to FIG. 1 to FIG. 8. FIG. 1 shows a layout view of a liquid crystal display, according to an example embodiment of the present invention. FIG. 2 shows a cross-sectional view of a liquid crystal display of FIG. 1 with respect to the line II-II. FIG. 3 shows a layout view of a first portion of a first sub-pixel electrode of a liquid crystal display of FIG. 1. FIG. 4 shows a layout view of a second portion of a first sub-pixel electrode and a second sub-pixel electrode of a liquid crystal display of FIG. 1. FIG. 5 shows a cross-sectional view of a liquid crystal display of FIG. 1 with respect to the line V-V. FIG. 6 shows a cross-sectional view of a liquid crystal display of FIG. 1 with respect to the line VI-VI. FIG. 7 shows a cross-sectional view of a liquid crystal display of FIG. 1 with respect to the line VII-VII. FIG. 8 shows a cross-sectional view of a liquid crystal display of FIG. 1 with respect to the line VIII-VIII.

Referring to FIG. 1 and FIG. 2, the liquid crystal display, according to the present example embodiment, includes a first display panel 100 and a second display panel 200 facing each other, and a liquid crystal layer 3 provided between the display panels 100 and 200.

The first display panel 100 will now be described.

A gate line 121, a reference voltage line 131, and a storage electrode 135 are formed on a first substrate 110 made of transparent glass, plastic, or the like. The gate line 121 generally extends in a horizontal direction and transmits a gate signal.

The gate line 121 includes a first gate electrode 124*a*, a second gate electrode 124*b*, a third gate electrode 124*c*, and a wide end portion for connection to another layer or an external driving circuit.

The reference voltage line 131 may extend in parallel with the gate line 121, and it includes an expansion 136 which is coupled to (e.g., connected to) a third drain electrode 175*c* to be described below in more detail.

The reference voltage line 131 includes the storage electrode 135 surrounding a pixel area.

A gate insulating layer 140 is formed on the gate line 121, the reference voltage line 131, and the storage electrode 135.

A first semiconductor 154*a*, a second semiconductor 154*b*, and a third semiconductor 154*c* made of amorphous silicon, crystalline silicon, or the like, are formed on the gate insulating layer 140.

A plurality of ohmic contacts 163*a*, 163*b*, 163*c*, 165*a*, 165*b*, and 165*c* are formed on the first semiconductor 154*a*, the second semiconductor 154*b*, and the third semiconductor 154*c*. When the semiconductors 154*a*, 154*b*, and 154*c* are oxide semiconductors, the ohmic contacts may be omitted.

Data conductors 171, 173*a*, 173*b* 173*c*, 175*a*, 175*b*, and 175*c* including a data line 171 including a first source electrode 173*a* and a second source electrode 173*b*, a first drain electrode 175*a*, a second drain electrode 175*b*, a third source electrode 173*c*, and a third drain electrode 175*c* are formed on the ohmic contacts 163*a*, 163*b*, 163*c*, 165*a*, 165*b*, and 165*c* and the gate insulating layer 140.

The second drain electrode 175*b* is coupled to the third source electrode 173*c*.

The first gate electrode 124*a*, the first source electrode 173*a*, and the first drain electrode 175*a* form a first thin film transistor Qa together with the first semiconductor 154*a*, and a channel of the thin film transistor is formed on the semiconductor 154*a* provided between the first source electrode 173*a* and the first drain electrode 175*a*. Similarly, the second gate electrode 124*b*, the second source electrode 173*b*, and the second drain electrode 175*b* form a second thin film transistor Qb together with the second semiconductor 154*b*, and the channel of the thin film transistor is formed on the semiconductor 154*b* provided between the second source electrode 173*b* and the second drain electrode 175*b*, while the third gate electrode 124*c*, the third source electrode 173*c*, and the third drain electrode 175*c* form a third thin film transistor (Qc) together with the third semiconductor 154*c*, and the channel of the thin film transistor is formed on the semiconductor 154*c* provided between the third source electrode 173*c* and the third drain electrode 175*c*.

A first passivation layer 180*a* made of an inorganic insulator such as silicon nitride or silicon oxide is formed on the data conductors 171, 173*a*, 173*b* 173*c*, 175*a*, 175*b*, and 175*c* and the exposed semiconductors 154*a*, 154*b*, and 154*c*.

A color filter 230 is provided on the first passivation layer 180*a*.

A light blocking member may be provided in a region in which the color filter 230 is not provided and on a part of the color filter 230. The light blocking member is also referred to as a black matrix, and reduces (e.g., prevents) light leakage.

A capping layer 80 is provided on the color filter 230. The capping layer 80 substantially prevents (e.g., prevents) the color filter 230 from lifting, and also controls contamination of the liquid crystal layer 3 caused by an organic material, such as a solvent provided by the color filter.

A first sub-region 191*a*1 of a first sub-pixel electrode 191*a* is formed on the capping layer 80.

Referring to FIG. 3, the first sub-region 191*a*1 of the first sub-pixel electrode 191*a* includes a cross connector provided in a center of the pixel area and a plurality of parallelograms provided near the cross connector to surround the cross connector, and the first sub-region 191*a*1 has a planar form. A first extension 193 is provided at the center of the cross connector. The first extension 193 also includes a protrusion extending upward and downward from a horizontal center of the pixel area. As described, the first sub-region 191*a*1 of the first sub-pixel electrode 191*a* is provided on a portion of the pixel area.

A second passivation layer 180*b* is formed on the capping layer 80 and the first sub-region 191*a*1 of the first sub-pixel electrode 191*a*.

A second sub-region 191*a*2 of the first sub-pixel electrode 191*a* and a second sub-pixel electrode 191*b* are formed on the second passivation layer 180*b*.

Referring to FIG. 4, the second sub-region 191*a*2 of the first sub-pixel electrode 191*a* is provided in a center of a pixel, and has a rhombus shape. The second sub-region 191*a*2 of the first sub-pixel electrode 191*a* includes a cross stem having a horizontal unit and a perpendicular unit, and a plurality of first branch electrodes 194 extending from the cross stem. The first branch electrodes 194 extend in four directions.

The second sub-pixel electrode 191*b* is formed to surround the second sub-region 191*a*2 of the first sub-pixel electrode 191*a*. The second sub-pixel electrode 191*b* includes an outer stem 192*a* formed along an edge of a pixel area, a plurality of second branch electrodes 195 formed near the second sub-region 191*a*2 of the first sub-pixel electrode 191*a* and extend substantially in parallel with (e.g., in parallel with) a plurality of first branch electrodes 194, an extension 192*b* coupled to (e.g., connected to) the second branch electrodes 195 and having a planar form in a planar shape, and a plurality of third branch electrodes 196 provided between the extension 192*b* and the outer stem 192*a* and extend substantially in parallel with a plurality of first branch electrodes 194 and a plurality of second branch electrodes 195. The planar shape signifies a plate shape, and the plate indicates a whole flat shape that is not broken into pieces. The extension 192*b* of the second sub-pixel electrode 191*b* is formed with a combination of four parallelograms.

The second branch electrodes 195 of the second sub-pixel electrode 191*b* overlap a part of the first sub-region 191*a*1 of the first sub-pixel electrode 191*a*.

A first contact opening (e.g., first contact hole) 185*a* for exposing a part of the first drain electrode 175*a* is formed in the first passivation layer 180*a* and the capping layer 80, and a second contact opening (e.g., a second contact hole) 185*b* for exposing a part of the second drain electrode 175*b* is formed in the first passivation layer 180*a*, the capping layer 80, and the second passivation layer 180*b*. A third contact opening (e.g., a third contact hole) 186 for exposing a center of the first sub-region 191*a*1 of the first sub-pixel electrode 191*a* is formed in the second passivation layer 180*b*.

The first sub-region 191*a*1 of the first sub-pixel electrode 191*a* is physically and electrically coupled to the first drain electrode 175*a* through the first contact opening 185*a*, and the second sub-pixel electrode 191*b* is physically and electrically coupled to the second drain electrode 175*b* through the second contact opening 185*b*. The second sub-region 191*a*2 of the first sub-pixel electrode 191*a* is coupled to a first extension 193 of the first sub-region 191*a*1 of the first sub-pixel electrode 191*a* through the third contact opening 186 formed in the second passivation layer 180*b*.

The first sub-pixel electrode 191*a* and the second sub-pixel electrode 191*b* receive a data voltage from the first drain electrode 175*a* and the second drain electrode 175*b* through the first contact opening 185*a* and the second contact opening 185*b*, respectively.

The second display panel 200 will now be described.

A light blocking member 220 and a common electrode 270 are formed on a second substrate 210 made of transparent glass, plastic, or the like.

However, the light blocking member 220 may be provided on the first display panel 100 in a liquid crystal display according to another example embodiment of the present invention, and a color filter may be provided on the second display panel 200 in a liquid crystal display according to a further example embodiment of the present invention.

Alignment layers are formed inside the display panels 100 and 200, and they may be vertical alignment layers.

Polarizers are provided outside the display panels 100 and 200, transmissive axes of the polarizers are substantially orthogonal to (e.g., orthogonal to) each other, and it is desirable for one of the transmissive axes to be parallel with the gate line 121. However, the polarizers may be located outside one of the display panels 100 and 200.

The liquid crystal layer 3 has negative dielectric anisotropy, and liquid crystal molecules of the liquid crystal layer 3 are oriented so that major axes thereof are aligned perpendicular to the surfaces of the two display panels 100 and 200 in the state in which no electric field is present. Therefore, incident light does not pass through the orthogonal polarizers but is blocked in the state in which no electric field is present.

At least one of the liquid crystal layer 3 and the alignment layer may include a photo-reactive material, and in more detail, a reactive mesogen.

A method for driving a liquid crystal display, according to an example embodiment of the present invention, will now be described.

When a gate-on signal is applied to the gate line 121, the gate-on signal is applied to the first gate electrode 124*a*, the second gate electrode 124*b*, and the third gate electrode 124*c* to turn on the first switching element (Qa), the second switching element (Qb), and the third switching element (Qc). Therefore, the data voltage applied to the data line 171 is applied to the first subpixel electrode 191*a* and the second subpixel electrode 191*b* through the turned-on first switching element (Qa) and second switching element (Qb), respectively. In this example, a voltage having the same level is applied to the first subpixel electrode 191*a* and the second subpixel electrode 191*b*. However, the voltage applied to the second subpixel electrode 191*b* is divided through the third switching element (Qc), which is coupled to the second switching element (Qb) in series. Accordingly, the voltage applied to the second subpixel electrode 191*b* is less than the voltage applied to the first subpixel electrode 191*a*.

Referring to FIG. 1, a single pixel area of the liquid crystal display, according to the present example embodiment, includes a first region (R1) in which the second sub-region 191*a*2 of the first sub-pixel electrode 191*a* is provided, a second region (R2) in which part of the first sub-region 191*a*1 of the first sub-pixel electrode 191*a* overlaps second branch electrodes 195 of the second sub-pixel electrode 191*b*, a third region (R3) in which an extension 192*b* of the second sub-pixel electrode 191*b* is provided, and a fourth region (R4) in which a plurality of third branch electrodes 196 of the second sub-pixel electrode 191*b* are provided.

The first region (R1), the second region (R2), the third region (R3), and the fourth region (R4) each have four sub-regions.

An area of the second region (R2) may be substantially twice the area of the first region (R1). A sum of the areas of the third region (R3) and the fourth region (R4) may be substantially three times the area of the second region (R2) and six times the area of the first region (R1).

Further, an area of the extension 192*b* of the second sub-pixel electrode 191*b* corresponding to the third region (R3) may be about 5% to about 60% of the area of the second sub-pixel electrode 191*b*.

The first region (R1), the second region (R2), the third region (R3), and the fourth region (R4) included in one pixel area of a liquid crystal display, according to the present example embodiment, will now be described with reference to FIG. 5 to FIG. 8.

Referring to FIG. 5, the first region (R1) of one pixel area of the liquid crystal display according to the present example embodiment, is provided on the first display panel 100, and the second sub-region 191*a*2 of the first sub-pixel electrode 191*a* coupled to the first extension 193 of the first sub-region 191*a*1 of the first sub-pixel electrode 191*a* and the common electrode 270 provided on the second display panel 200 generate an electric field. The second sub-region 191*a*2 of the first sub-pixel electrode 191*a* includes a cross stem and a plurality of first branch electrodes 194 extending in four different directions. The first branch electrodes 194 may be slanted by about 40 to about 45 degrees with respect to the gate line 121. The liquid crystal molecules of the liquid crystal layer 3 provided in the first region (R1) lie in four different directions by a fringe field occurring on edges of the first branch electrodes 194. Further, a horizontal component of the fringe field induced by a plurality of first branch electrodes 194 is substantially orthogonal to (e.g., orthogonal to) sides of the first branch electrodes 194 such that the liquid crystal molecules are influenced by the fringe field caused by respective sides of the first branch electrodes 194, and are inclined in a direction that is substantially parallel to (e.g., parallel to) a lengthwise direction of the first branch electrodes 194.

Referring to FIG. 6, a plurality of second branch electrodes 195 of the second sub-pixel electrode 191*b* provided on the first display panel 100 overlap the first sub-region 191*a*1 of the first sub-pixel electrode 191*a* in the second region (R2) of one pixel area of the liquid crystal display, according to the present example embodiment. Therefore, the liquid crystal molecules of the liquid crystal layer 3 are arranged by the electric field formed between the first sub-region 191*a*1 of the first sub-pixel electrode 191*a* and the common electrode 270 together with the electric field formed between a plurality of second branch electrodes 195 of the second sub-pixel electrode 191*b* and the common electrode 270 of the second display panel 200.

Since the second branch electrodes 195 extend in a direction that is substantially parallel to a plurality of first branch electrodes 194, the liquid crystal molecules of the liquid crystal layer 3 provided in the second region (R2) lie in four different directions in a manner similar to the liquid crystal molecules of the liquid crystal layer 3 provided in the first region (R1).

Referring to FIG. 7, the liquid crystal molecules of the liquid crystal layer 3 are arranged by the electric field formed between the extension 192*b* of the second sub-pixel electrode 191*b* provided on the first display panel 100 and the common electrode 270 provided on the second display panel 200 in the third region (R3) of one pixel area of the liquid crystal display, according to the present example embodiment.

Referring to FIG. 8, a plurality of third branch electrodes 196 of the second sub-pixel electrode 191*b* provided on the first display panel 100 generate an electric field together with the common electrode 270 provided on the second display panel 200 in the fourth region (R4) of one pixel area of the liquid crystal display, according to the present example embodiment. Since the third branch electrodes 196 extend in a direction that is substantially parallel to a plurality of first branch electrodes 194 and a plurality of second branch electrodes 195, the liquid crystal molecules of the liquid crystal layer 3 provided in the fourth region (R4) lie in four different directions in a manner similar to the liquid crystal molecules of the liquid crystal layer 3 provided in the first region (R1) and the second region (R2).

As described above, the extension 192*b* of the second sub-pixel electrode 191*b* has a plate shape to increase transmittance of the liquid crystal display and make an intensity of the electric field formed between the extension 192*b* in the plate shape and the common electrode 270 greater than an intensity of the electric field formed between the third branch electrodes 196 and the common electrode 270.

Further, the liquid crystal molecules of the liquid crystal layer 3 in a location that corresponds to the third region (R3) are influenced by the liquid crystal molecules that lie in four different directions due to the fringe field formed by a plurality of second branch electrodes 195 and a plurality of third branch electrodes 196 of the second region (R2) and the fourth region (R4), and they lie in a lengthwise direction of the second branch electrodes 195 and the third branch electrodes 196.

As described above, the second voltage applied to the second sub-pixel electrode 191*b* is less than the first voltage applied to the first sub-pixel electrode 191*a*.

Therefore, the intensity of the electric field applied to the liquid crystal layer provided in the first region (R1) is the greatest, and the intensity of the electric field applied to the liquid crystal layer provided in the fourth region (R4) is the least. The second region (R2) is influenced by the electric field of the first sub-pixel electrode 191*a* provided at a lower side of the second sub-pixel electrode 191*b* such that the intensity of the electric field applied to the liquid crystal layer provided in the second region (R2) is less than the intensity of the electric field applied to the liquid crystal layer provided in the first region (R1) and is greater than the intensity of the electric field applied to the liquid crystal layer provided in the third region (R3) and the fourth region (R4). Regarding the third region (R3) and the fourth region (R4) to which the voltage with the same level is applied, the intensity of the electric field of the third region (R3) having the extension 192*b* in the plate shape is greater than the intensity of the electric field of the fourth region (R4) having a plurality of third branch electrodes 196. Therefore, the intensity of the electric field applied to the liquid crystal layer 3 is reduced in the first region (R1), the second region (R2), the third region (R3), and the fourth region (R4), and the reduction of the intensity of the electric field in the enumerated four regions (R1 to R4) increases in the order of enumeration of the four regions.

Regarding the liquid crystal display according to the example embodiment of the present invention, one pixel area is divided into four regions with different intensities of the electric field applied to the liquid crystal layer 3 so that the angles of the liquid crystal molecules are different in the respective regions and luminances of the respective regions are different. When one pixel area is divided into four regions with different values of luminance as described, the change of transmittance induced by gray levels is gently controlled and the steep change of transmittance according to the change of gray levels on the side in the low gray level and the high gray level is reduced (e.g., prevented) such that the lateral visibility approaches the front visibility and that the liquid crystal display expresses accurate grays at the low gray level and the high gray level.

Also, the first region (R1), the second region (R2), the third region (R3), and the fourth region (R4) have a small gap between adjacent regions, so one pixel area is divided into a plurality of regions with different intensities of the electric field applied to the liquid crystal layer 3 and a reduction of transmittance of the pixel area may be reduced (e.g., prevented).

Further, the liquid crystal molecules of the liquid crystal layer 3 corresponding to the third region (R3) may be controlled to be in a direction substantially parallel to the liquid crystal molecules of the liquid crystal layer 3 corresponding to the adjacent region, by forming the area of the extension 192*b* in the plate shape forming the third region (R3) to be about 5% to about 60% of the entire area of the second sub-pixel electrode 191*b*.

Figure 9:
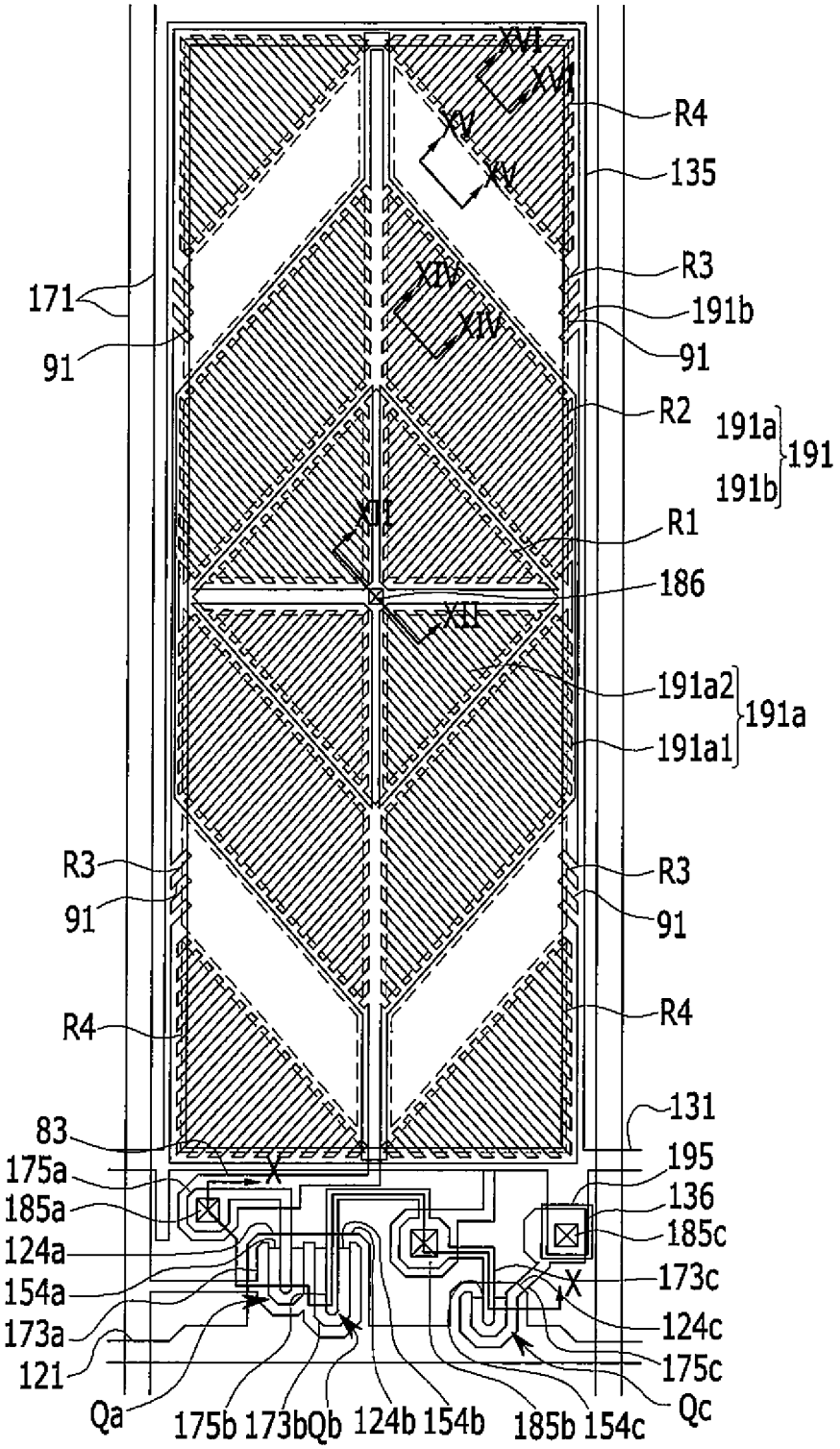
FIG. 9 shows a layout view of a liquid crystal display, according to another example embodiment of the present invention.
Figure 10:
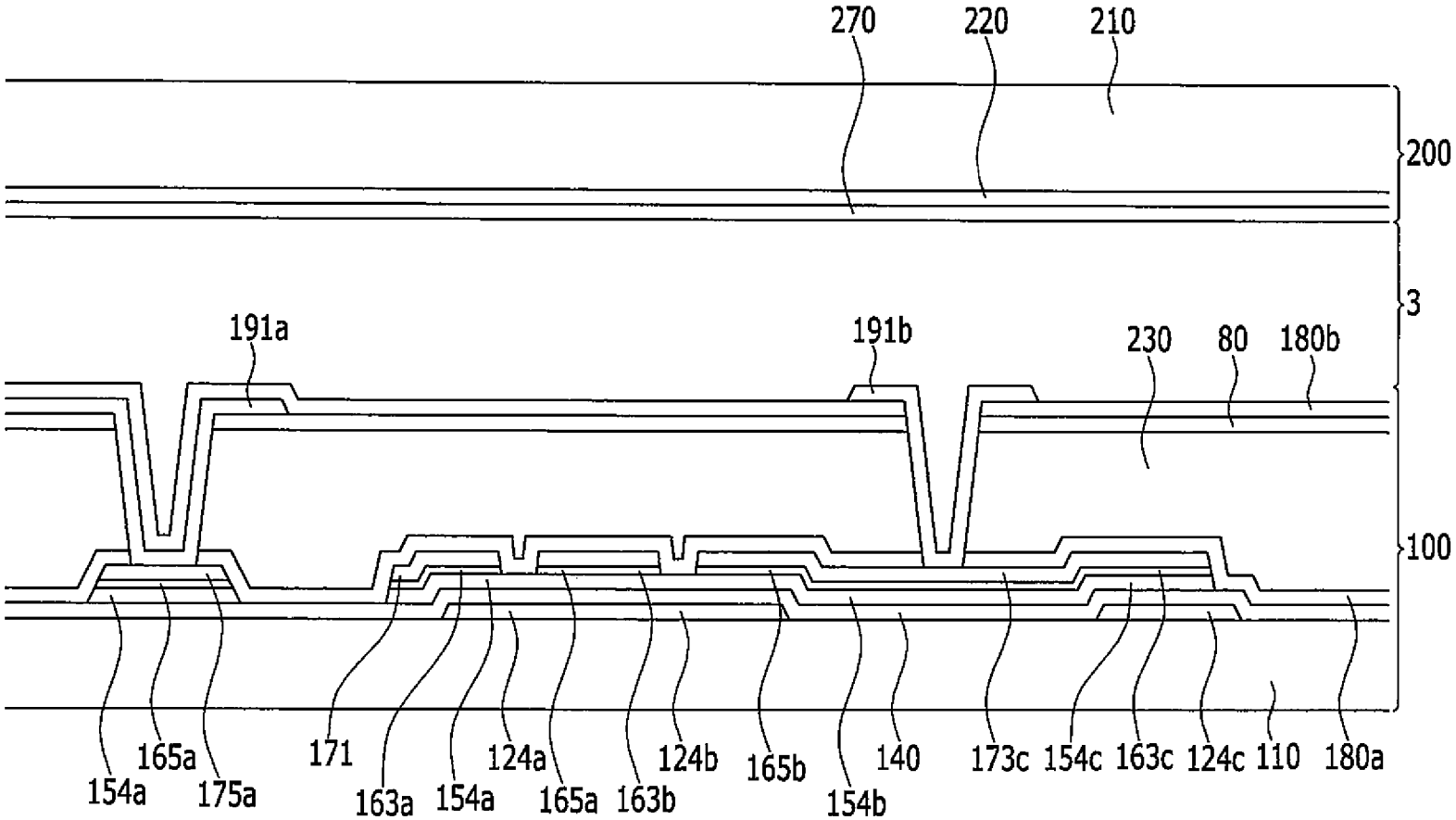
FIG. 10 shows a cross-sectional view of a liquid crystal display of FIG. 9 with respect to the line X-X.
Figure 11:
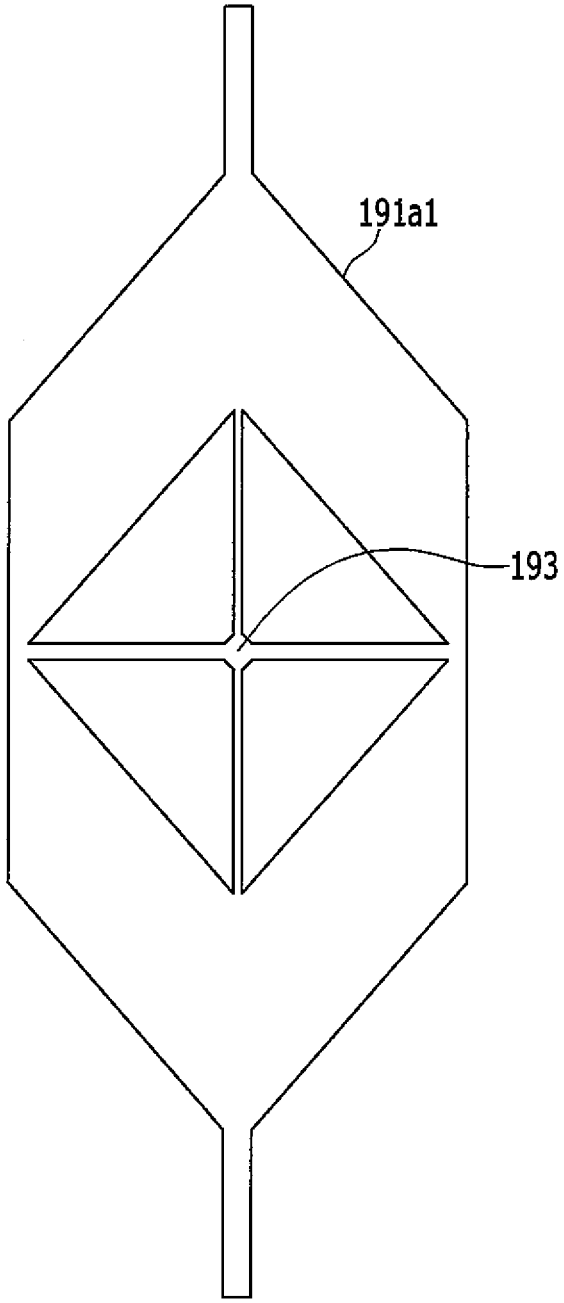
FIG. 11 shows a layout view of a first portion of a first sub-pixel electrode of a liquid crystal display of FIG. 10.
Figure 12:
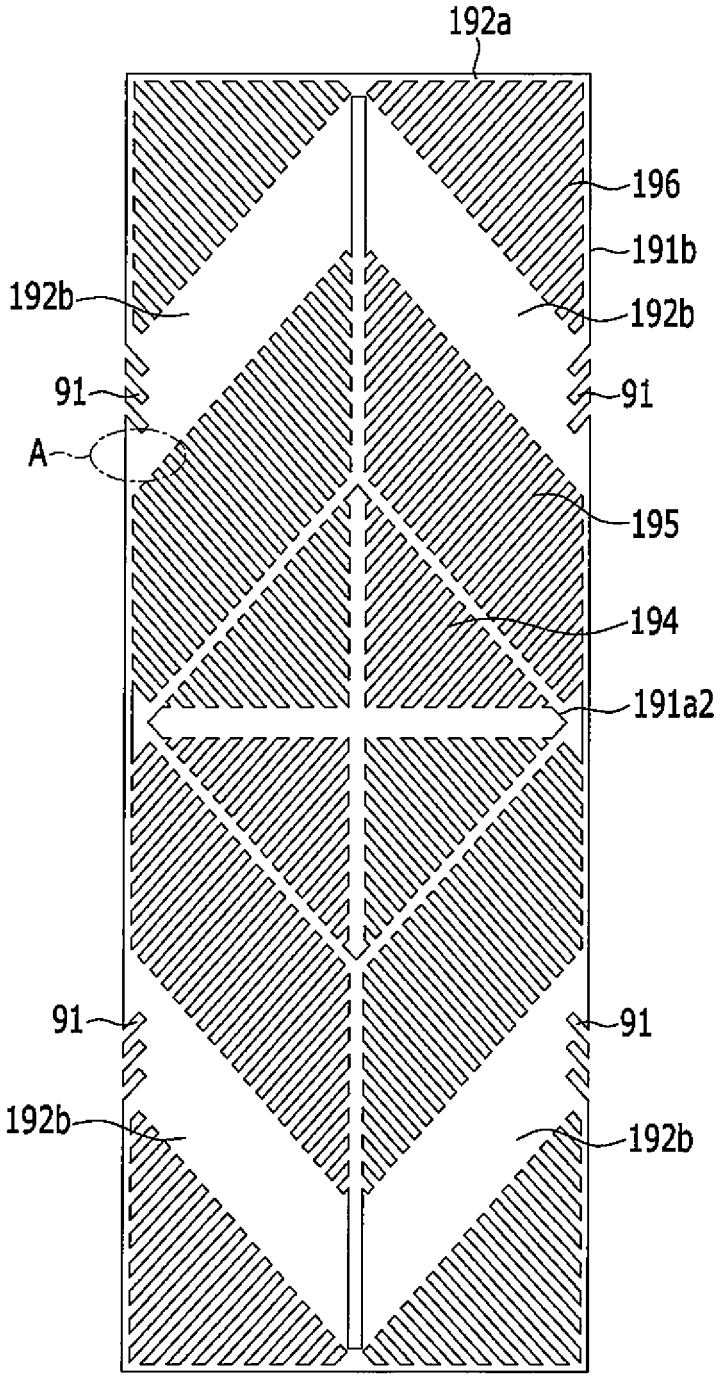
FIG. 12 shows a layout view of a second portion of a first sub-pixel electrode and a second sub-pixel electrode of a liquid crystal display of FIG. 10.
Figure 13:
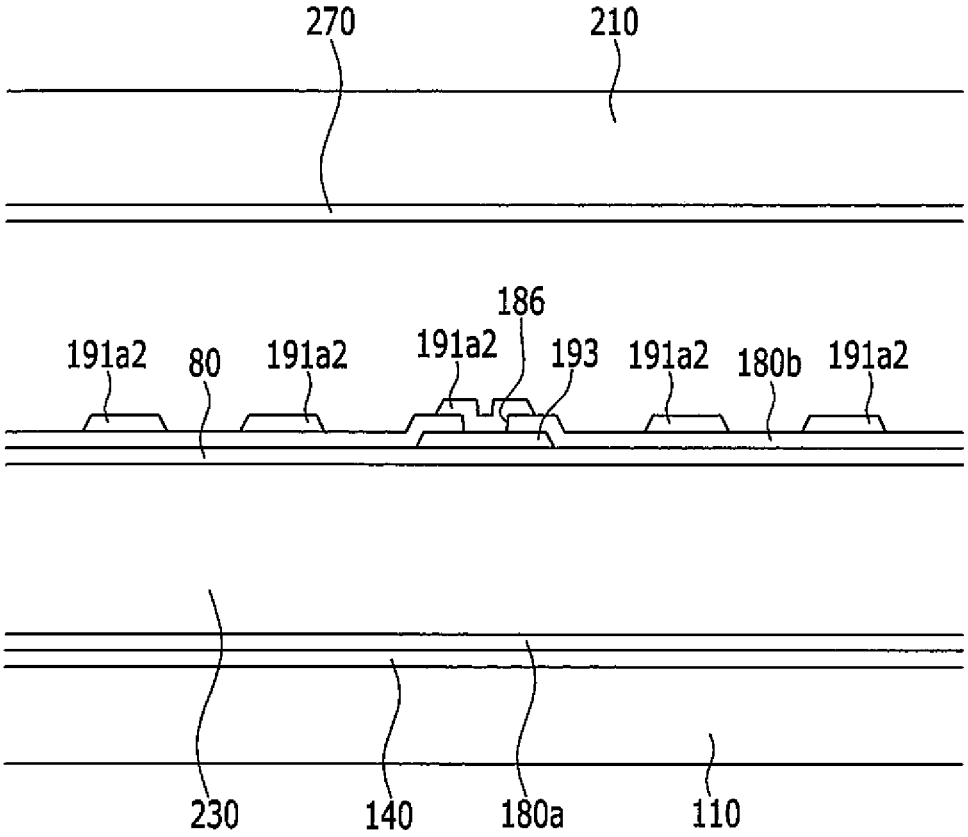
FIG. 13 shows a cross-sectional view of a liquid crystal display of FIG. 9 with respect to the line XIII-XIII.
Figure 14:
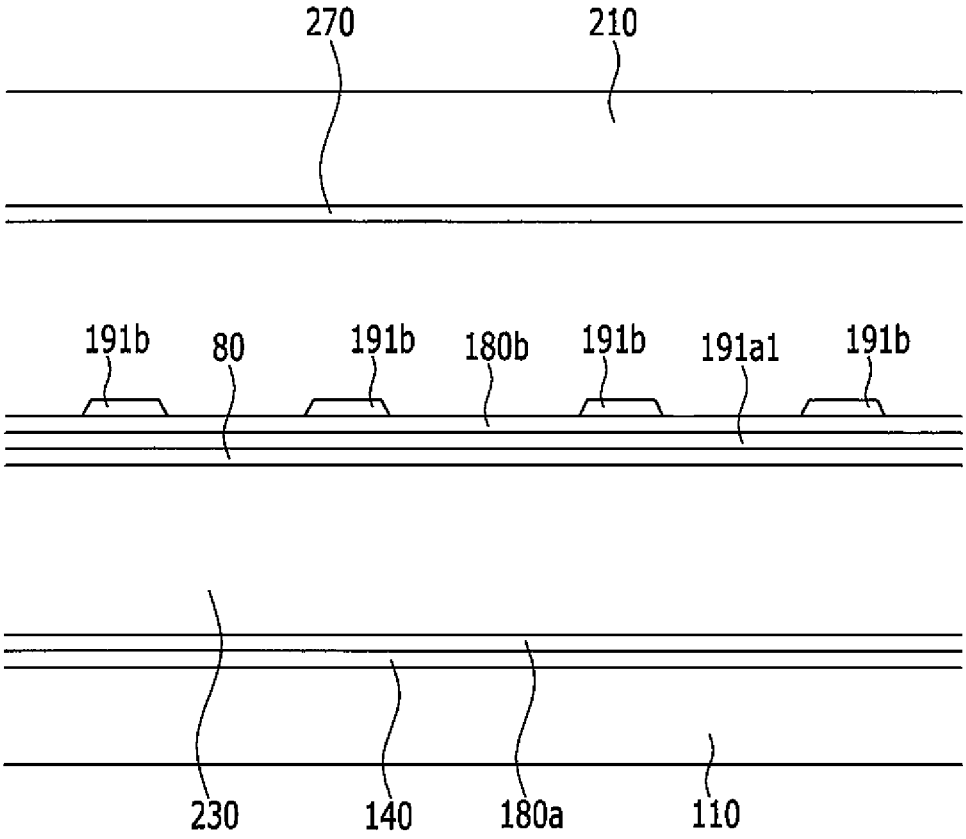
FIG. 14 shows a cross-sectional view of a liquid crystal display of FIG. 9 with respect to the line XIV-XIV.
Figure 15:
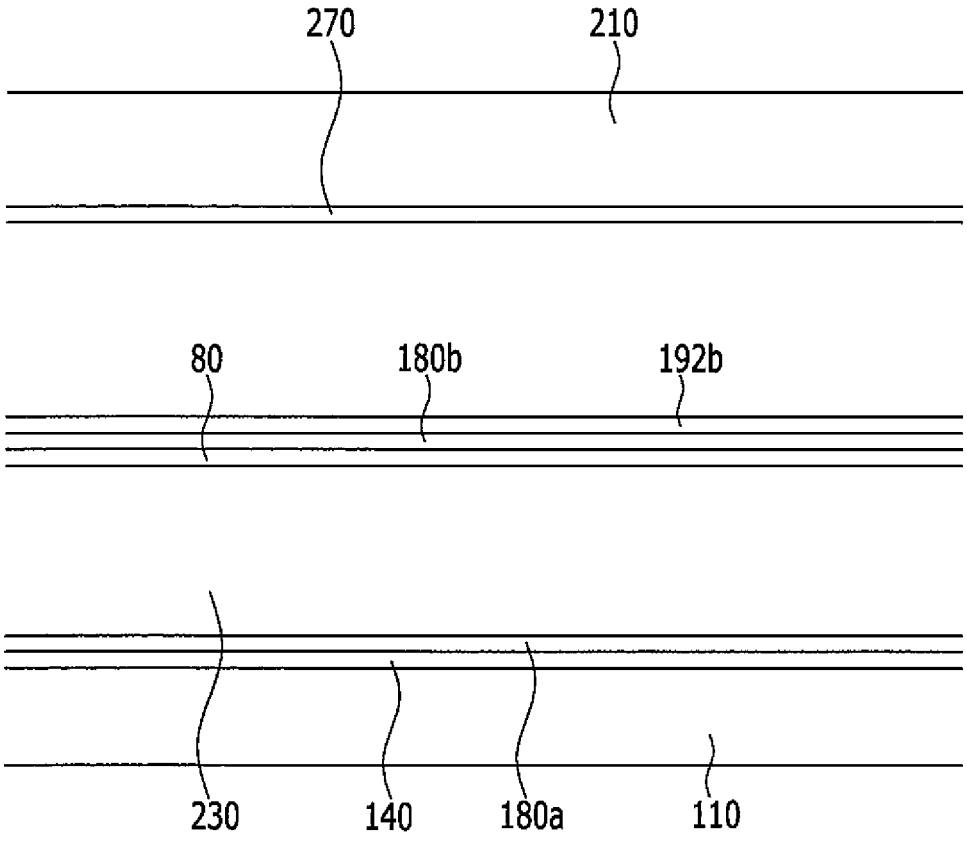
FIG. 15 shows a cross-sectional view of a liquid crystal display of FIG. 9 with respect to the line XV-XV.
Figure 16:
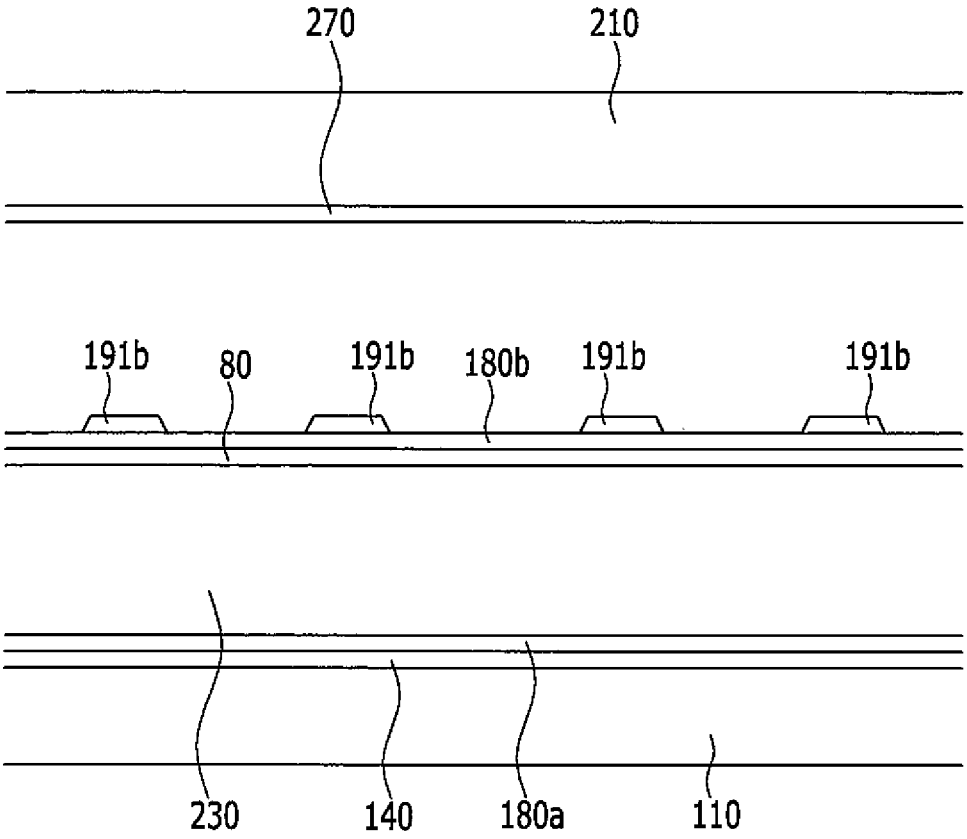
FIG. 16 shows a cross-sectional view of a liquid crystal display of FIG. 9 with respect to the line XVI-XVI.

A liquid crystal display, according to another example embodiment of the present invention, will now be described with reference to FIG. 9 to FIG. 16. FIG. 9 shows a layout view of a liquid crystal display according to another example embodiment of the present invention. FIG. 10 shows a layout view of a first sub-pixel electrode of a liquid crystal display of FIG. 9. FIG. 11 shows a layout view of a part of an insulating layer of a liquid crystal display of FIG. 9. FIG. 12 shows a layout view of a second sub-pixel electrode of a liquid crystal display of FIG. 9. FIG. 13 shows a cross-sectional view of a liquid crystal display of FIG. 9 with respect to the line XIII-XIII. FIG. 14 shows a cross-sectional view of a liquid crystal display of FIG. 9 with respect to the line XIV-XIV. FIG. 15 shows a cross-sectional view of a liquid crystal display of FIG. 9 with respect to the line XV-XV. FIG. 16 shows a cross-sectional view of a liquid crystal display of FIG. 9 with respect to the line XVI-XVI.

Referring to FIG. 9 to FIG. 16, the liquid crystal display according to the present example embodiment is similar to the liquid crystal display according to the example embodiment described with reference to FIG. 1 to FIG. 8. A detailed description of elements having similar reference numerals may not be provided.

In a manner similar to that of the liquid crystal display according to the example embodiment described with reference to FIG. 1 to FIG. 8, in the liquid crystal display according to the present example embodiment, one pixel area includes a first region (R1) in which a second sub-region 191*a*2 of a first sub-pixel electrode 191*a* is provided, a second region (R2) in which part of a first sub-region 191*a*1 of the first sub-pixel electrode 191*a* overlaps a second branch electrodes 195 of a second sub-pixel electrode 191*b*, a third region (R3) in which an extension 192*b* of the second sub-pixel electrode 191*b* is provided, and a fourth region (R4) in which a plurality of third branch electrodes 196 of the second sub-pixel electrode 191*b* are provided. The first region (R1), the second region (R2), the third region (R3), and the fourth region (R4) each have four sub-regions.

An area of the second region (R2) may be substantially twice the area of the first region (R1), and a sum of the areas of the third region (R3) and the fourth region (R4) may be substantially three times the area of the second region (R2). Further, an area of the extension 192*b* of the second sub-pixel electrode 191*b* corresponding to the third region (R3) may be about 5% to about 60% of the area of the second sub-pixel electrode 191*b*.

The first region (R1) of one pixel area of the liquid crystal display, according to the present example embodiment, is provided on the first display panel 100, and the second sub-region 191*a*2 of the first sub-pixel electrode 191*a* coupled to the first extension 193 of the first sub-region 191*a*1 of the first sub-pixel electrode 191*a* and the common electrode 270 provided on the second display panel 200 generate an electric field. The second sub-region 191*a*2 of the first sub-pixel electrode 191*a* includes a cross stem and a plurality of first branch electrodes 194 extending in four different directions. The first branch electrodes 194 may be slanted by about 40 to about 45 degrees with respect to the gate line 121. The liquid crystal molecules of the liquid crystal layer 3 provided in the first region (R1) lie in four different directions by a fringe field occurring on edges of the first branch electrodes 194. In an embodiment, a horizontal component of the fringe field induced by a plurality of first branch electrodes 194 is substantially orthogonal to (e.g., orthogonal to) sides of the first branch electrodes 194 such that the liquid crystal molecules are influenced by the fringe field caused by respective sides of the first branch electrodes 194 and are inclined in a direction that is substantially parallel to (e.g. parallel to) a lengthwise direction of the first branch electrodes 194.

A plurality of second branch electrodes 195 of the second sub-pixel electrode 191*b* provided on the first display panel 100 overlap the first sub-region 191*a*1 of the first sub-pixel electrode 191*a* in the second region (R2) of one pixel area of the liquid crystal display, according to the present example embodiment. Therefore, the liquid crystal molecules of the liquid crystal layer 3 are arranged by the electric field formed between the first sub-region 191*a*1 of the first sub-pixel electrode 191*a* and the common electrode 270 together with the electric field formed between a plurality of second branch electrodes 195 of the second sub-pixel electrode 191*b* and the common electrode 270 of the second display panel 200.

Since the second branch electrodes 195 extend in a direction that is substantially parallel to a plurality of first branch electrodes 194, the liquid crystal molecules of the liquid crystal layer 3 provided in the second region (R2) lie in four different directions in a manner similar to the liquid crystal molecules of the liquid crystal layer 3 provided in the first region (R1).

The liquid crystal molecules of the liquid crystal layer 3 are arranged by the electric field formed between the extension 192*b* of the second sub-pixel electrode 191*b* and the common electrode 270 provided on the second display panel 200 in the third region (R3) of one pixel area of the liquid crystal display according to the present example embodiment.

A plurality of third branch electrodes 196 of the second sub-pixel electrode 191*b* provided on the first display panel 100 generate an electric field together with the common electrode 270 provided on the second display panel 200 in the fourth region (R4) of one pixel area of the liquid crystal display, according to the present example embodiment. Since the third branch electrodes 196 extend in a direction that is substantially parallel to a plurality of first branch electrodes 194 and a plurality of second branch electrodes 195, the liquid crystal molecules of the liquid crystal layer 3 provided in the fourth region (R4) lie in four different directions in a manner similar to the liquid crystal molecules of the liquid crystal layer 3 provided in the first region (R1) and the second region (R2).

As described above, the extension 192*b* of the second sub-pixel electrode 191*b* has a plate shape to increase transmittance of the liquid crystal display and make an intensity of the electric field formed between the extension 192*b* in the plate shape and the common electrode 270 greater than an intensity of the electric field formed between the third branch electrodes 196 and the common electrode 270.

Differing from the liquid crystal display according to the example embodiment shown in FIG. 1 to FIG. 8, the liquid crystal display according to the present example embodiment includes a first cutout 91 formed along an edge of the extension 192*b* of the second sub-pixel electrode 191*b*. The first cutout 91 is formed to be substantially parallel with a part of a plurality of first branch electrodes 194, a plurality of second branch electrodes 195, and a plurality of third branch electrodes 196.

Liquid crystal molecules of a liquid crystal layer 3 corresponding to an edge surrounding the extension 192*b* of the second sub-pixel electrode 191*b* may be inclined in a manner similar to first liquid crystal molecules (A) due to the influence of a fringe field applied in a direction that is substantially orthogonal to (e.g., orthogonal to) the edge of the extension 192*b*. The direction in which the first liquid crystal molecules (A) are inclined is different from the direction in which the liquid crystal molecules are inclined in the first region (R1), the second region (R2), and the fourth region (R4). Particularly, the extension 192*b* of the second sub-pixel electrode 191*b* has a plate shape such that the fringe field formed by the edge is large. Therefore, the direction in which the liquid crystal molecules corresponding to the edge of the extension 192*b* becomes the same as the direction in which the first liquid crystal molecules (A) are inclined, and transmittance of the liquid crystal display may be accordingly deteriorated (e.g., reduced) near the edge of the extension 192*b*. However, according to the liquid crystal display according to the present example embodiment, the liquid crystal molecules that include the first cutout 91 formed along the edge of the extension 192*b* of the second sub-pixel electrode 191*b* and correspond to the edge of the extension 192*b* of the second sub-pixel electrode 191*b* by the first cutout 91 may be inclined in a direction that is substantially parallel to the direction in which the liquid crystal molecules are inclined in the first region (R1), the second region (R2), and the fourth region (R4) in a manner similar to the second liquid crystal molecules (B). Therefore, deterioration of (e.g., reduction of) transmittance of the liquid crystal display that may occur near the edge of the extension 192*b* may be reduced (e.g., prevented).

As described above, the second voltage applied to the second sub-pixel electrode 191*b* is less than the first voltage applied to the first sub-pixel electrode 191*a*.

Therefore, the intensity of the electric field applied to the liquid crystal layer provided in the first region (R1) is the greatest, and the intensity of the electric field applied to the liquid crystal layer provided in the fourth region (R4) is the least. The second region (R2) is influenced by the electric field of the first sub-pixel electrode 191*a* provided at a lower side of the second sub-pixel electrode 191*b* such that the intensity of the electric field applied to the liquid crystal layer provided in the second region (R2) is less than the intensity of the electric field applied to the liquid crystal layer provided in the first region (R1), and is greater than the intensity of the electric field applied to the liquid crystal layer provided in the third region (R3) and the fourth region (R4). Regarding the third region (R3) and the fourth region (R4) to which the voltage with the same level is applied, the intensity of the electric field of the third region (R3) having the extension 192*b* in the plate shape is greater than the intensity of the electric field of the fourth region (R4) having a plurality of third branch electrodes 196. Therefore, the intensity of the electric field applied to the liquid crystal layer 3 is reduced in the first region (R1), the second region (R2), the third region (R3), and the fourth region (R4), and the reduction of the intensity of the electric field in the enumerated four regions (R1 to R4) increases in the order of enumeration of the four regions.

Regarding the liquid crystal display, according to the example embodiment of the present invention, one pixel area is divided into four regions with different intensities of the electric field applied to the liquid crystal layer 3 so that the angles of the liquid crystal molecules are different in the respective regions and luminances of the respective regions are different. When one pixel area is divided into four regions with different values of luminance as described, the change of transmittance induced by gray levels is gently controlled and the steep change of transmittance according to the change of gray levels on the side in the low gray level and the high gray level is reduced (e.g., prevented) such that the lateral visibility approaches the front visibility and that the liquid crystal display expresses accurate grays in the low gray level and the high gray level.

Also, the first region (R1), the second region (R2), the third region (R3), and the fourth region (R4) have a small gap between adjacent regions, so one pixel area is divided into a plurality of regions with different intensities of the electric field applied to the liquid crystal layer 3, and a reduction of transmittance of the pixel area may be reduced (e.g., prevented).

Further, the liquid crystal molecules of the liquid crystal layer 3 corresponding to the third region (R3) may be controlled to be in a direction substantially parallel to the liquid crystal molecules of the liquid crystal layer 3 corresponding to the adjacent region by forming the area of the extension 192*b* in the plate shape forming the third region (R3) to be about 5% to about 60% of the entire area of the second sub-pixel electrode 191*b*.

Many characteristics of the liquid crystal display according to the example embodiment described with reference to FIG. 1 to FIG. 8 are applicable to the liquid crystal display according to the present example embodiment.

Figure 17:
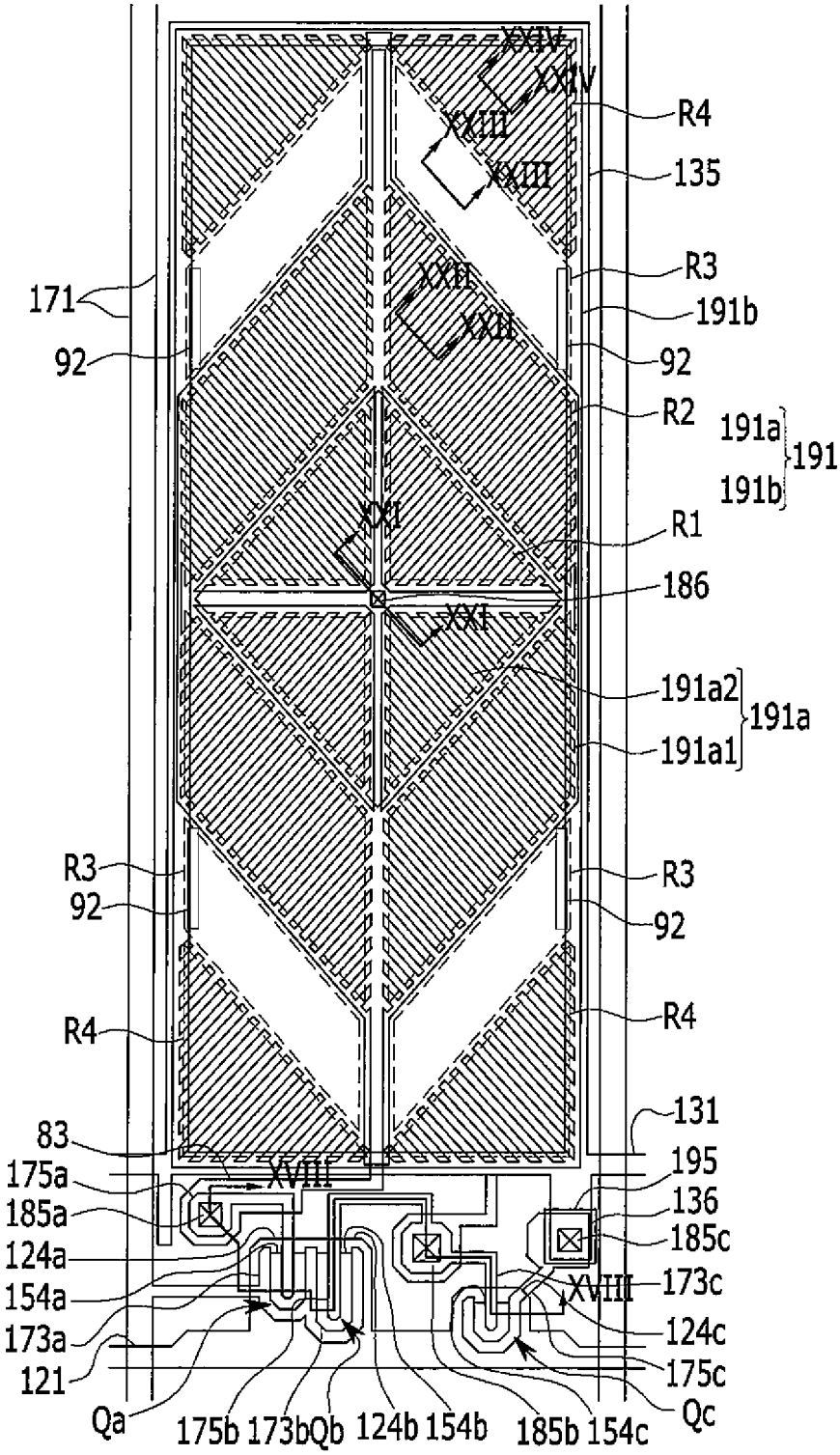
FIG. 17 shows a layout view of a liquid crystal display, according to another example embodiment of the present invention.
Figure 18:
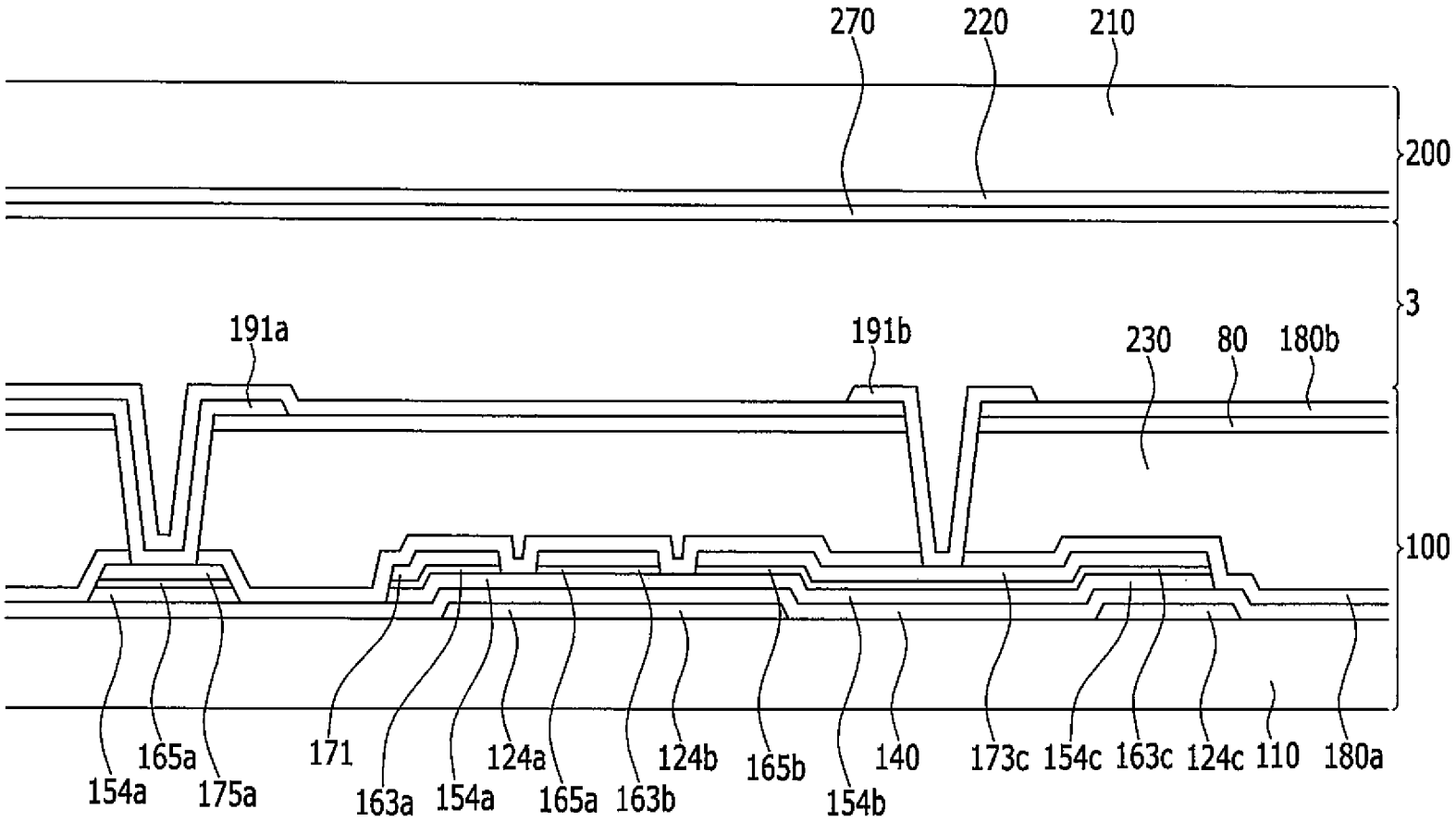
FIG. 18 shows a cross-sectional view of a liquid crystal display of FIG. 17 with respect to the line XVIII-XVIII.
Figure 19:
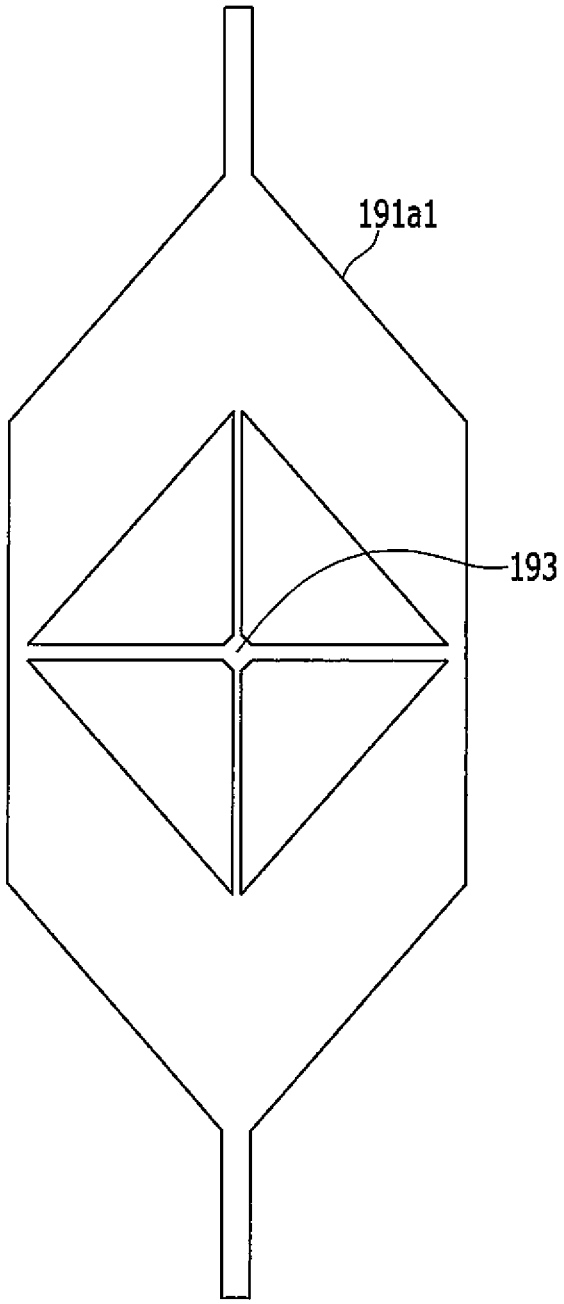
FIG. 19 shows a layout view of a first portion of a first sub-pixel electrode of a liquid crystal display of FIG. 17.
Figure 20:
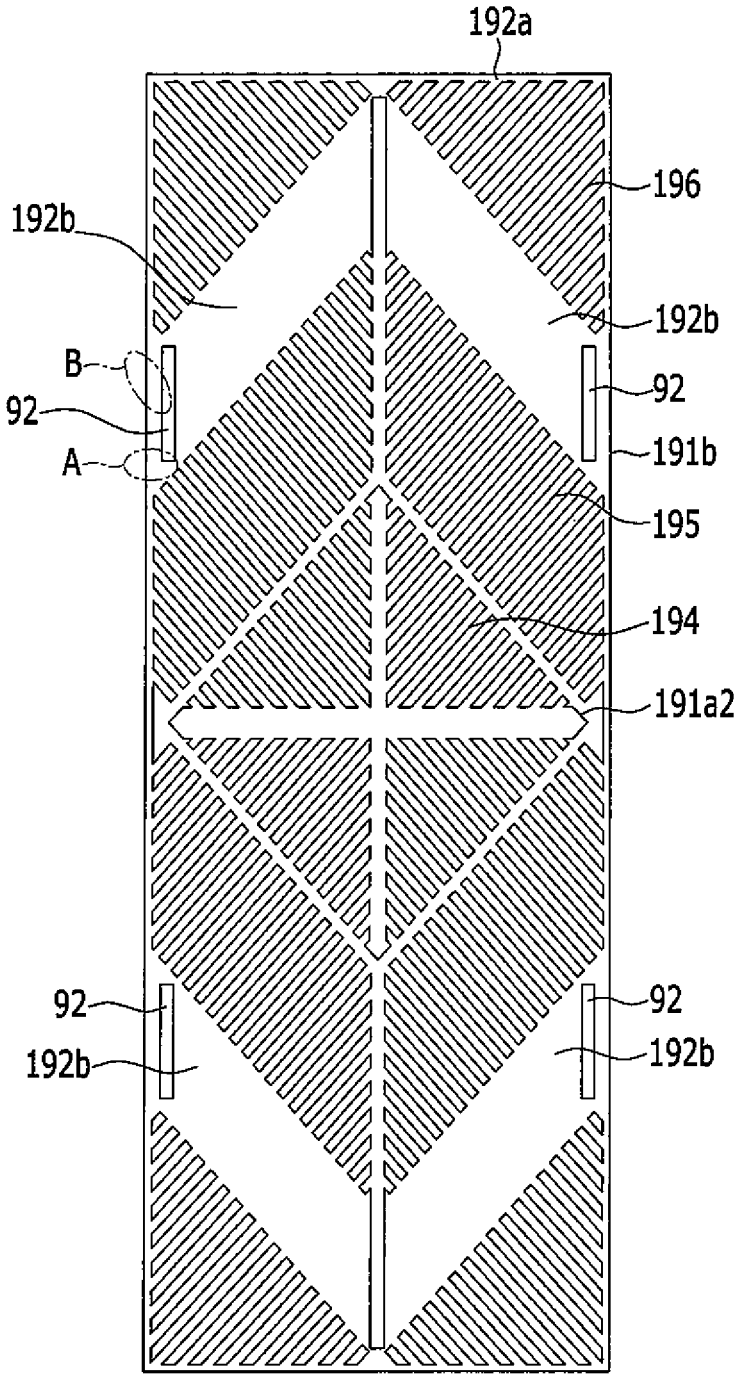
FIG. 20 shows a layout view of a second portion of a first sub-pixel electrode and a second sub-pixel electrode of a liquid crystal display of FIG. 17.
Figure 21:
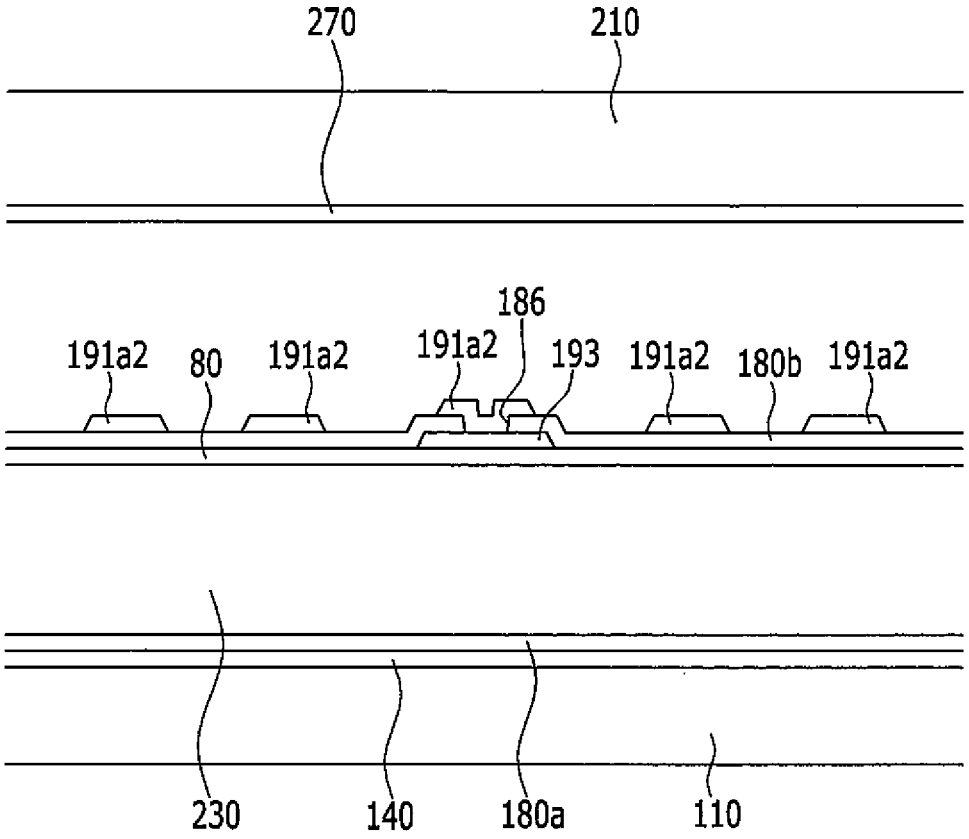
FIG. 21 shows a cross-sectional view of a liquid crystal display of FIG. 17 with respect to the line XXI-XXI.
Figure 22:
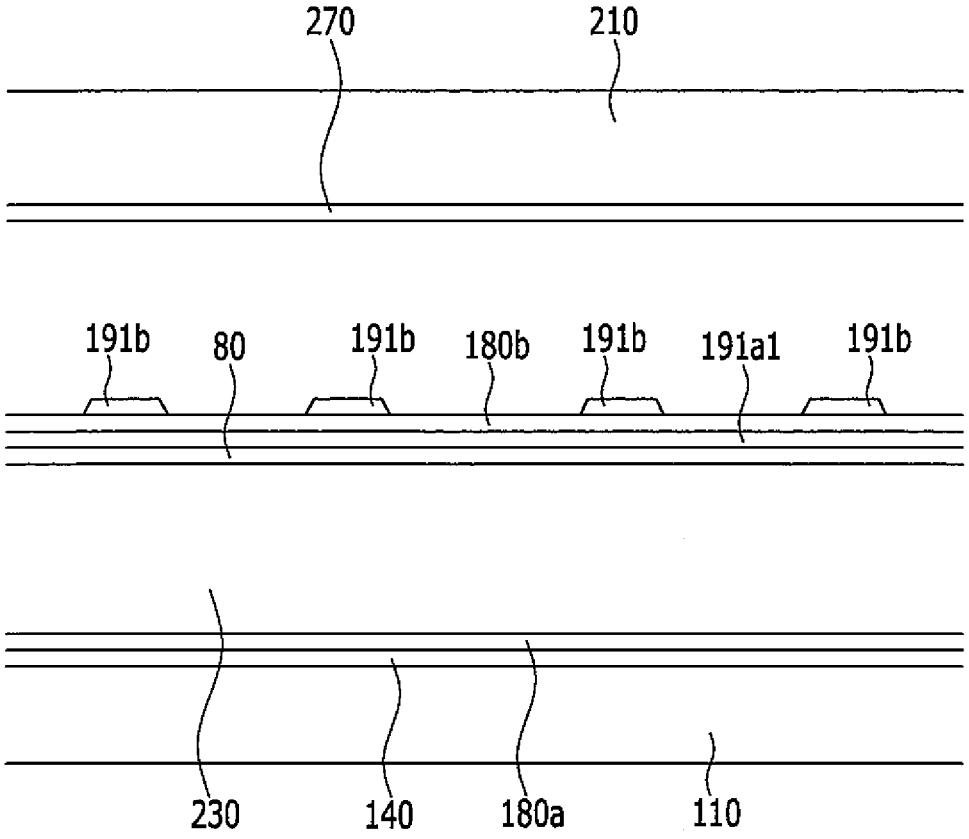
FIG. 22 shows a cross-sectional view of a liquid crystal display of FIG. 17 with respect to the line XXII-XXII.
Figure 23:
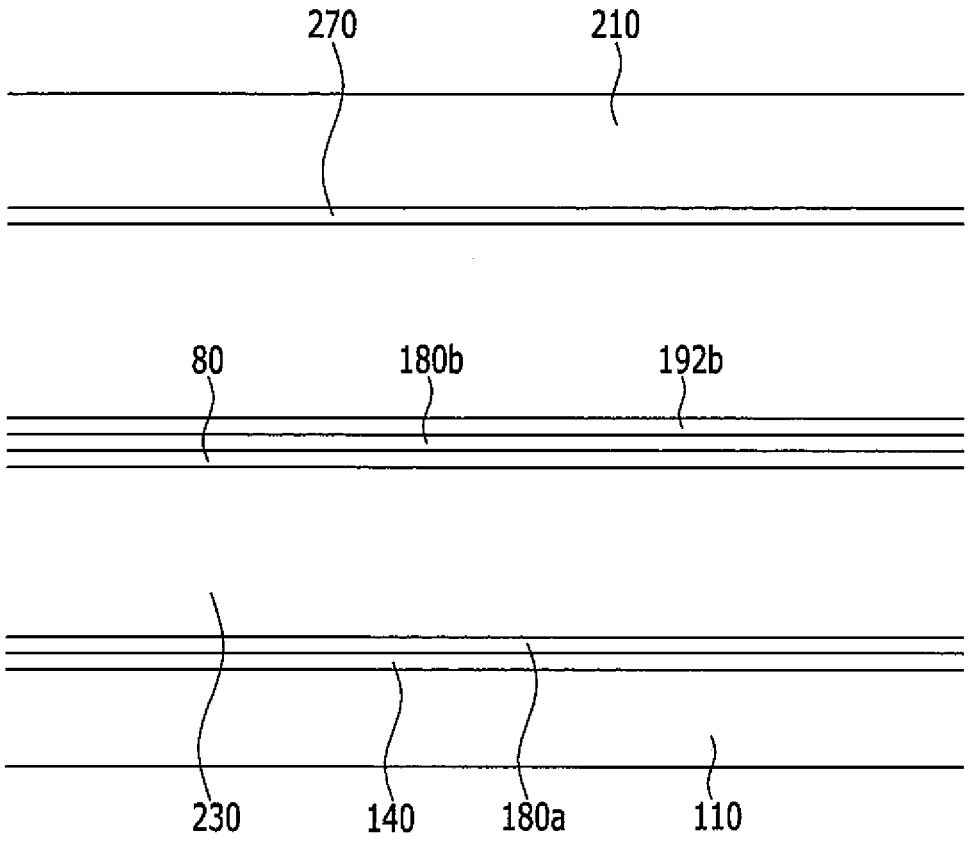
FIG. 23 shows a cross-sectional view of a liquid crystal display of FIG. 17 with respect to the line XXIII-XXIII.
Figure 24:
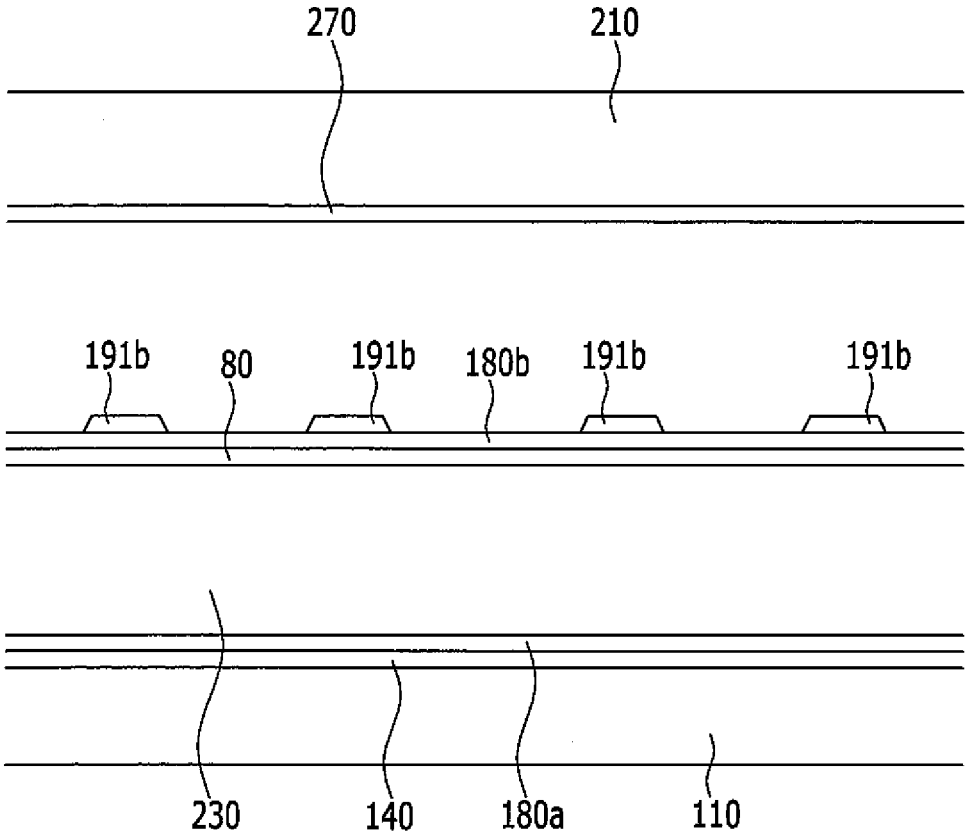
FIG. 24 shows a cross-sectional view of a liquid crystal display of FIG. 17 with respect to the line XXIV-XXIV.

Referring to FIG. 17 to FIG. 24, a liquid crystal display, according to another example embodiment of the present invention, will now be described. FIG. 17 shows a layout view of a liquid crystal display, according to the present example embodiment of the present invention. FIG. 18 shows a cross-sectional view of a liquid crystal display of FIG. 17 with respect to the line XVIII-XVIII. FIG. 19 shows a layout view of a first portion of a first sub-pixel electrode of a liquid crystal display of FIG. 17. FIG. 20 shows a layout view of a second portion of a first sub-pixel electrode and a second sub-pixel electrode of a liquid crystal display of FIG. 17. FIG. 21 shows a cross-sectional view of a liquid crystal display of FIG. 17 with respect to the line XXI-XXI. FIG. 22 shows a cross-sectional view of a liquid crystal display of FIG. 17 with respect to the line XXII-XXII. FIG. 23 shows a cross-sectional view of a liquid crystal display of FIG. 17 with respect to the line XXIII-XXIII. FIG. 24 shows a cross-sectional view of a liquid crystal display of FIG. 17 with respect to the line XXIV-XXIV.

Referring to FIG. 17 to FIG. 24, the liquid crystal display according to the present example embodiment is similar to the liquid crystal display according to the example embodiment described with reference to FIG. 1 to FIG. 8. A detailed description of the elements having similar reference numerals may not be provided.

In a manner similar to the liquid crystal display according to the example embodiment described with reference to FIG. 1 to FIG. 8, in the liquid crystal display according to the present example embodiment, one pixel area includes a first region (R1) in which a second sub-region 191*a*2 of a first sub-pixel electrode 191*a* is provided, a second region (R2) in which part of a first sub-region 191*a*1 of the first sub-pixel electrode 191*a* overlaps a second branch electrodes 195 of a second sub-pixel electrode 191*b*, a third region (R3) in which an extension 192*b* of the second sub-pixel electrode 191*b* is provided, and a fourth region (R4) in which a plurality of third branch electrodes 196 of the second sub-pixel electrode 191*b* are provided. The first region (R1), the second region (R2), the third region (R3), and the fourth region (R4) each have four sub-regions.

An area of the second region (R2) may be substantially twice the area of the first region (R1), and a sum of the areas of the third region (R3) and the fourth region (R4) may be substantially three times the area of the second region (R2). Further, an area of the extension 192*b* of the second sub-pixel electrode 191*b* corresponding to the third region (R3) may be about 5% to about 60% of the area of the second sub-pixel electrode 191*b*.

The first region (R1) of one pixel area of the liquid crystal display according to the present example embodiment is provided on the first display panel 100, and the second sub-region 191*a*2 of the first sub-pixel electrode 191*a* coupled to the first extension 193 of the first sub-region 191*a*1 of the first sub-pixel electrode 191*a* and the common electrode 270 provided on the second display panel 200 generate an electric field. The second sub-region 191*a*2 of the first sub-pixel electrode 191*a* includes a cross stem and a plurality of first branch electrodes 194 extending in four different directions. The first branch electrodes 194 may be slanted by about 40 to about 45 degrees with respect to the gate line 121. The liquid crystal molecules of the liquid crystal layer 3 provided in the first region (R1) lie in four different directions by a fringe field occurring on edges of the first branch electrodes 194. In an embodiment, a horizontal component of the fringe field induced by a plurality of first branch electrodes 194 is substantially orthogonal to (e.g., orthogonal to) sides of the first branch electrodes 194 such that the liquid crystal molecules are influenced by the fringe field caused by respective sides of the first branch electrodes 194 and are inclined in a direction that is substantially parallel to (e.g., parallel to) a lengthwise direction of the first branch electrodes 194.

A plurality of second branch electrodes 195 of the second sub-pixel electrode 191*b* provided on the first display panel 100 overlap the first sub-region 191*a*1 of the first sub-pixel electrode 191*a* in the second region (R2) of one pixel area of the liquid crystal display according to the present example embodiment. Therefore, the liquid crystal molecules of the liquid crystal layer 3 are arranged by the electric field formed between the first sub-region 191*a*1 of the first sub-pixel electrode 191*a* and the common electrode 270 together with the electric field formed between a plurality of second branch electrodes 195 of the second sub-pixel electrode 191*b* and the common electrode 270 of the second display panel 200.

Since the second branch electrodes 195 extend in a direction that is substantially parallel to a plurality of first branch electrodes 194, the liquid crystal molecules of the liquid crystal layer 3 provided in the second region (R2) lie in four different directions in a manner similar to the liquid crystal molecules of the liquid crystal layer 3 provided in the first region (R1).

The liquid crystal molecules of the liquid crystal layer 3 are arranged by the electric field formed between the extension 192*b* of the second sub-pixel electrode 191*b* provided on the first display panel 100 and the common electrode 270 provided on the second display panel 200 in the third region (R3) of one pixel area of the liquid crystal display, according to the present example embodiment.

A plurality of third branch electrodes 196 of the second sub-pixel electrode 191*b* provided on the first display panel 100 generate an electric field together with the common electrode 270 provided on the second display panel 200 in the fourth region (R4) of one pixel area of the liquid crystal display, according to the present example embodiment. Since the third branch electrodes 196 extend in a direction that is substantially parallel to a plurality of first branch electrodes 194 and a plurality of second branch electrodes 195, the liquid crystal molecules of the liquid crystal layer 3 provided in the fourth region (R4) lie in four different directions in a manner similar to the liquid crystal molecules of the liquid crystal layer 3 provided in the first region (R1) and the second region (R2).

As described above, the extension 192*b* of the second sub-pixel electrode 191*b* has a plate shape to increase transmittance of the liquid crystal display and make an intensity of the electric field formed between the extension 192*b* in the plate shape and the common electrode 270 greater than an intensity of the electric field formed between the third branch electrodes 196 and the common electrode 270.

Differing from the liquid crystal display according to the example embodiment shown in FIG. 1 to FIG. 8, the liquid crystal display according to the present example embodiment includes a second cutout 92 formed along an edge of the extension 192*b* of the second sub-pixel electrode 191*b*. The second cutout 92 is formed to be substantially parallel with the edge of the extension 192*b* of the second sub-pixel electrode 191*b*. As described above, the liquid crystal molecules of the liquid crystal layer 3 corresponding to an edge surrounding the extension 192*b* of the second sub-pixel electrode 191*b* may be inclined in a direction that is substantially orthogonal to (e.g., orthogonal to) the edge of the extension 192*b* due to the influence of a fringe field applied in a direction that is substantially orthogonal to the edge of the extension 192*b*, and the transmittance of the liquid crystal display may be accordingly deteriorated (e.g., reduced). However, according to the present example embodiment, the second cutout 92 is formed on the edge of the extension 192*b* of the second sub-pixel electrode 191*b* to reduce the influence of the fringe field formed on the edge of the extension 192*b* of the second sub-pixel electrode 191*b* and reduce (e.g., prevent) the liquid crystal molecules corresponding to the edge of the extension 192*b* from being inclined in the direction that is substantially orthogonal to the edge of the extension 192*b*, thereby decreasing reduction of transmittance.

As described above, the second voltage applied to the second sub-pixel electrode 191*b* is less than the first voltage applied to the first sub-pixel electrode 191*a*.

Therefore, the intensity of the electric field applied to the liquid crystal layer provided in the first region (R1) is the greatest, and the intensity of the electric field applied to the liquid crystal layer provided in the fourth region (R4) is the least. The second region (R2) is influenced by the electric field of the first sub-pixel electrode 191*a* provided at a lower side of the second sub-pixel electrode 191*b* such that the intensity of the electric field applied to the liquid crystal layer provided in the second region (R2) is less than the intensity of the electric field applied to the liquid crystal layer provided in the first region (R1) and is greater than the intensity of the electric field applied to the liquid crystal layer provided in the third region (R3) and the fourth region (R4). Regarding the third region (R3) and the fourth region (R4) to which the voltage with the same level is applied, the intensity of the electric field of the third region (R3) having the extension 192*b* in the plate shape is greater than the intensity of the electric field of the fourth region (R4) having a plurality of third branch electrodes 196. Therefore, the intensity of the electric field applied to the liquid crystal layer 3 is reduced in the first region (R1), the second region (R2), the third region (R3), and the fourth region (R4), and the reduction of the intensity of the electric field in the enumerated four regions (R1 to R4) increases in the order of enumeration of the four regions.

In the liquid crystal display according to the example embodiment of the present invention, one pixel area is divided into four regions with different intensities of the electric field applied to the liquid crystal layer 3 so that the angles of the liquid crystal molecules are different in the respective regions and luminances of the respective regions are different. When one pixel area is divided into four regions with different values of luminance as described, the change of transmittance induced by gray levels is gently controlled and the steep change of transmittance according to the change of gray levels on the side in the low gray level and the high gray level is reduced (e.g., prevented) such that the lateral visibility approach the front visibility and that the liquid crystal display expresses accurate grays in the low gray level and the high gray level.

Also, the first region (R1), the second region (R2), the third region (R3), and the fourth region (R4) have a small gap between adjacent regions, so one pixel area is divided into a plurality of regions with different intensities of the electric field applied to the liquid crystal layer 3 and a reduction of transmittance of the pixel area may be reduced (e.g., prevented).

Further, the liquid crystal molecules of the liquid crystal layer 3 corresponding to the third region (R3) may be controlled to be in a direction substantially parallel to the liquid crystal molecules of the liquid crystal layer 3 corresponding to the adjacent region by forming the area of the extension 192*b* in the plate shape forming the third region (R3) to be about 5% to about 60% of the entire area of the second sub-pixel electrode 191*b*.

Many characteristics of the liquid crystal displays according to the example embodiment described with reference to FIG. 1 to FIG. 8 and FIG. 9 to FIG. 16 are applicable to the liquid crystal display according to the present example embodiment.

Figure 25:
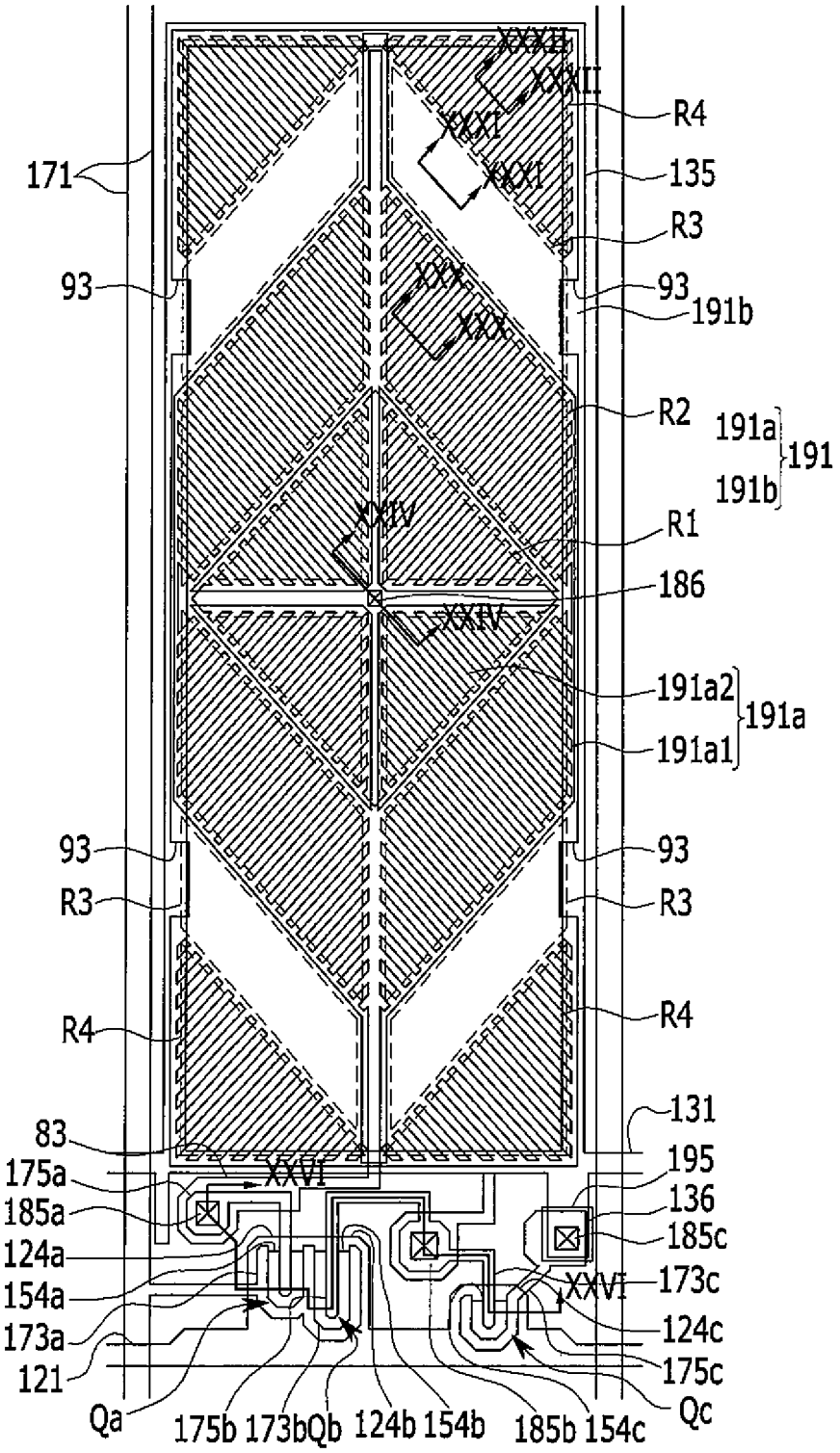
FIG. 25 shows a layout view of a liquid crystal display, according to another example embodiment of the present invention.
Figure 26:
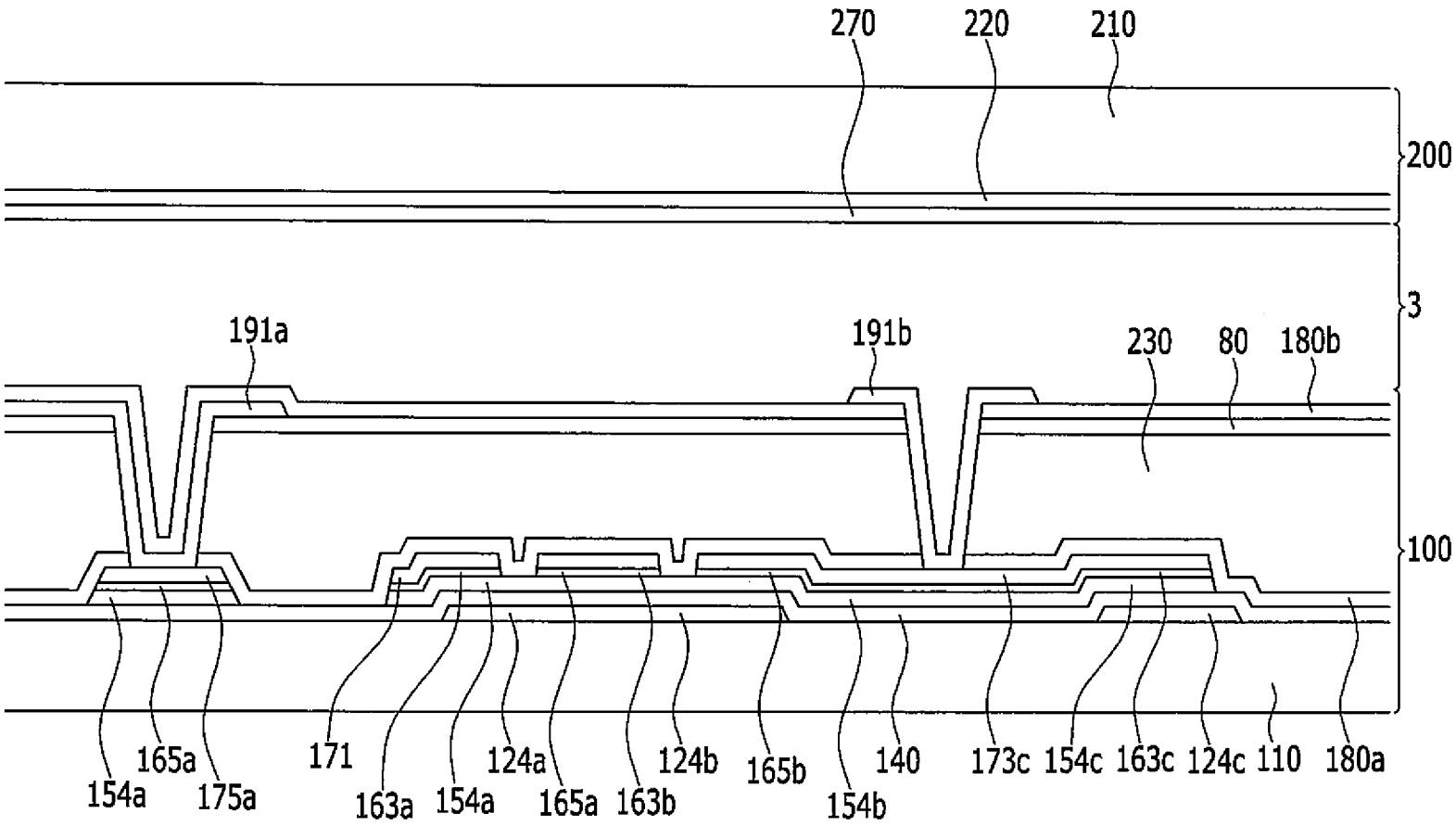
FIG. 26 shows a cross-sectional view of a liquid crystal display of FIG. 25 with respect to the line XXVI-XXVI.
Figure 27:
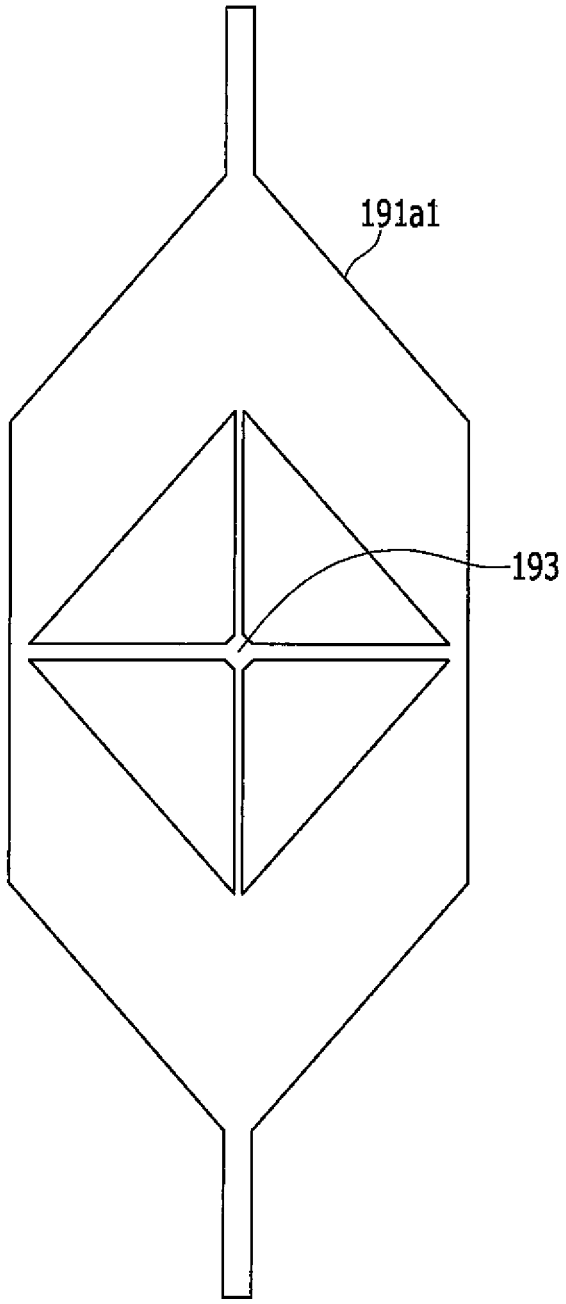
FIG. 27 shows a layout view of a first portion of a first sub-pixel electrode of a liquid crystal display of FIG. 25.
Figure 28:
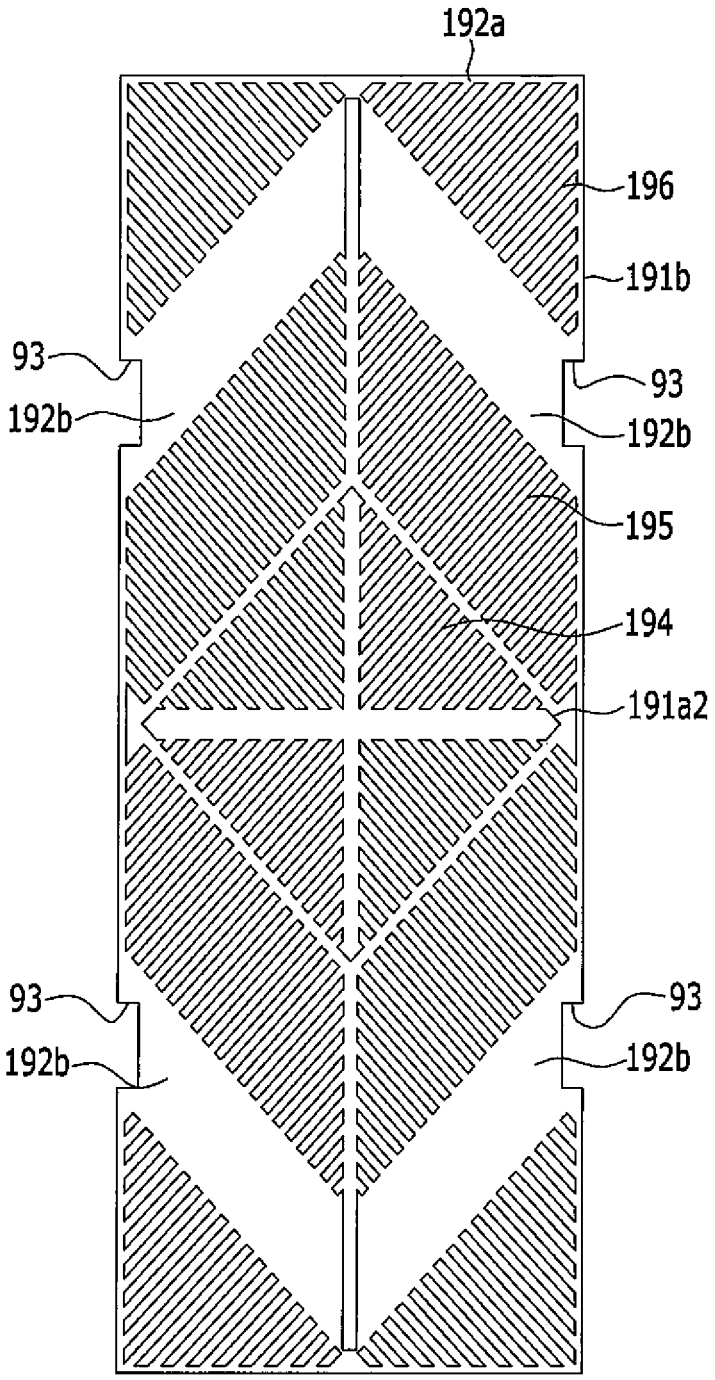
FIG. 28 shows a layout view of a second portion of a first sub-pixel electrode and a second sub-pixel electrode of a liquid crystal display of FIG. 25.
Figure 29:
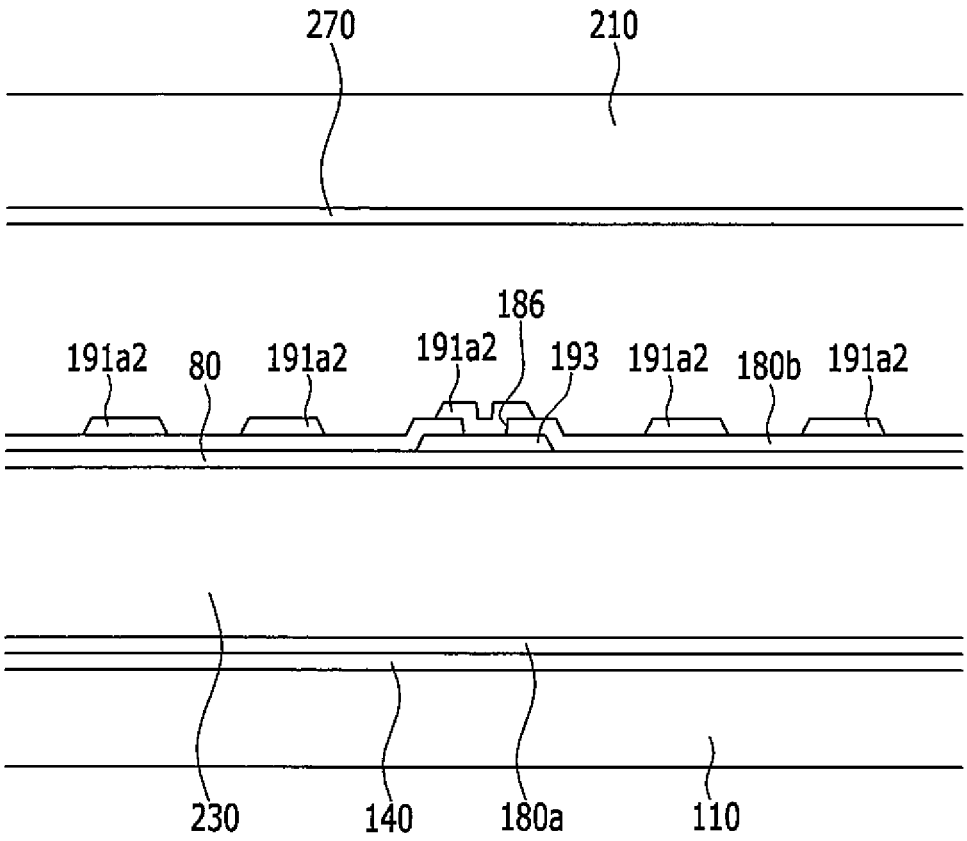
FIG. 29 shows a cross-sectional view of a liquid crystal display of FIG. 25 with respect to the line XXIX-XXIX.
Figure 30:
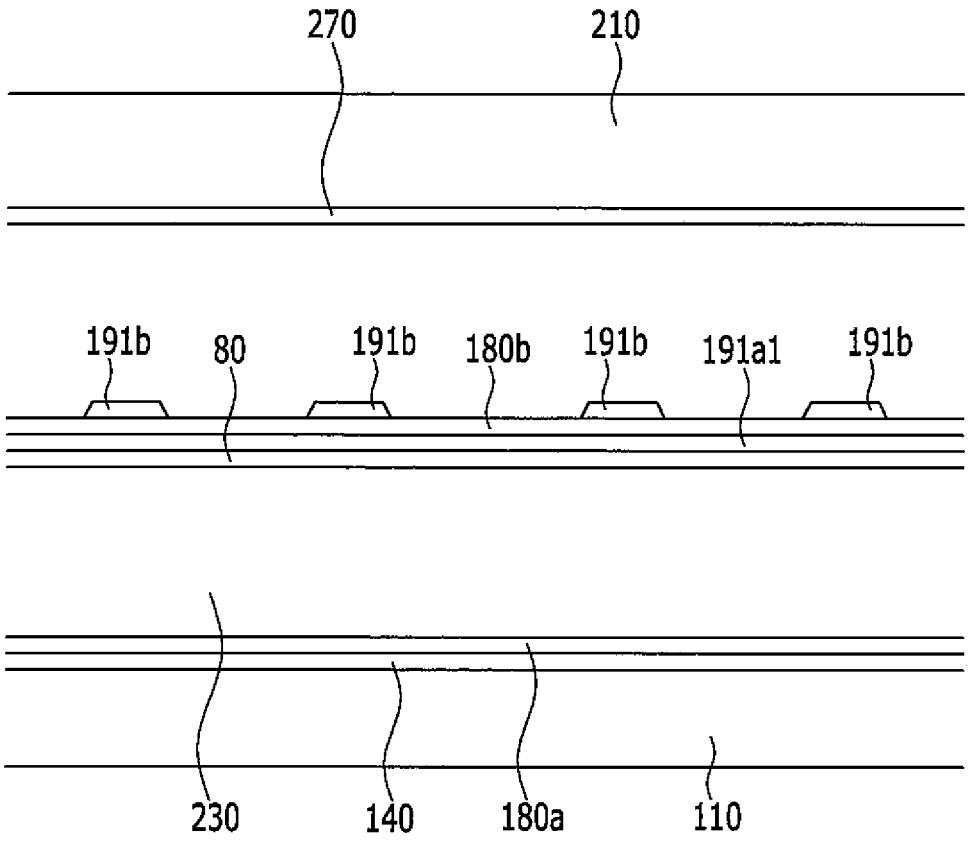
FIG. 30 shows a cross-sectional view of a liquid crystal display of FIG. 25 with respect to the line XXX-XXX.
Figure 31:
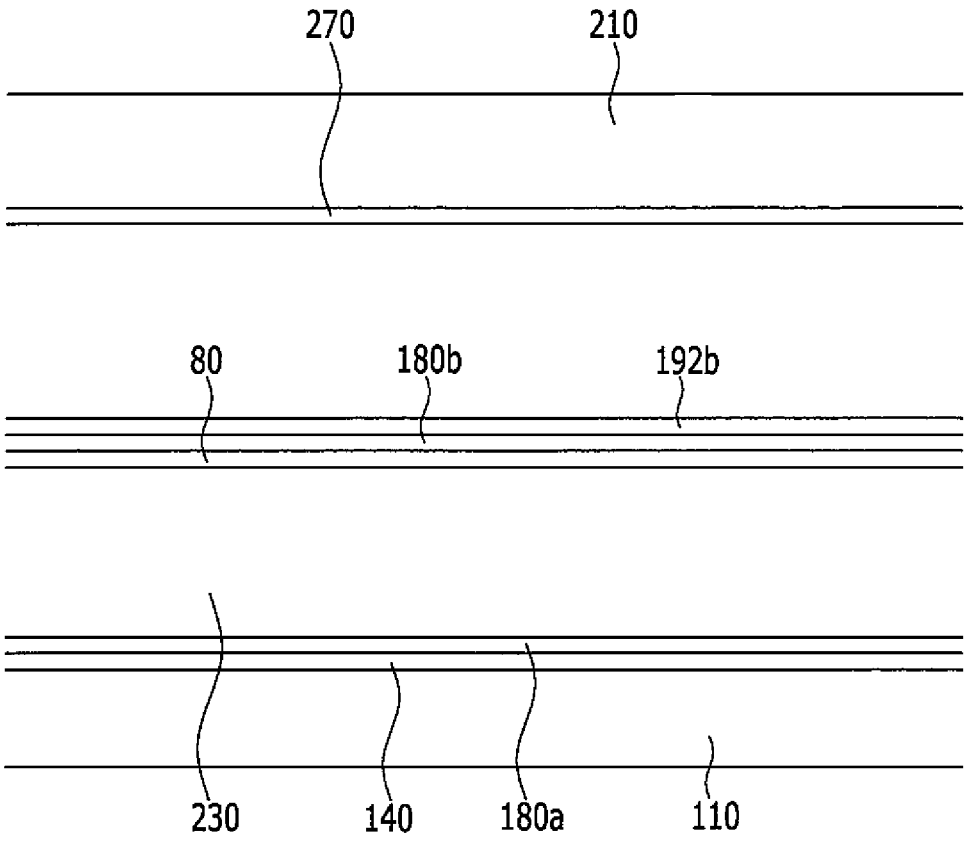
FIG. 31 shows a cross-sectional view of a liquid crystal display of FIG. 25 with respect to the line XXXI-XXXI.
Figure 32:
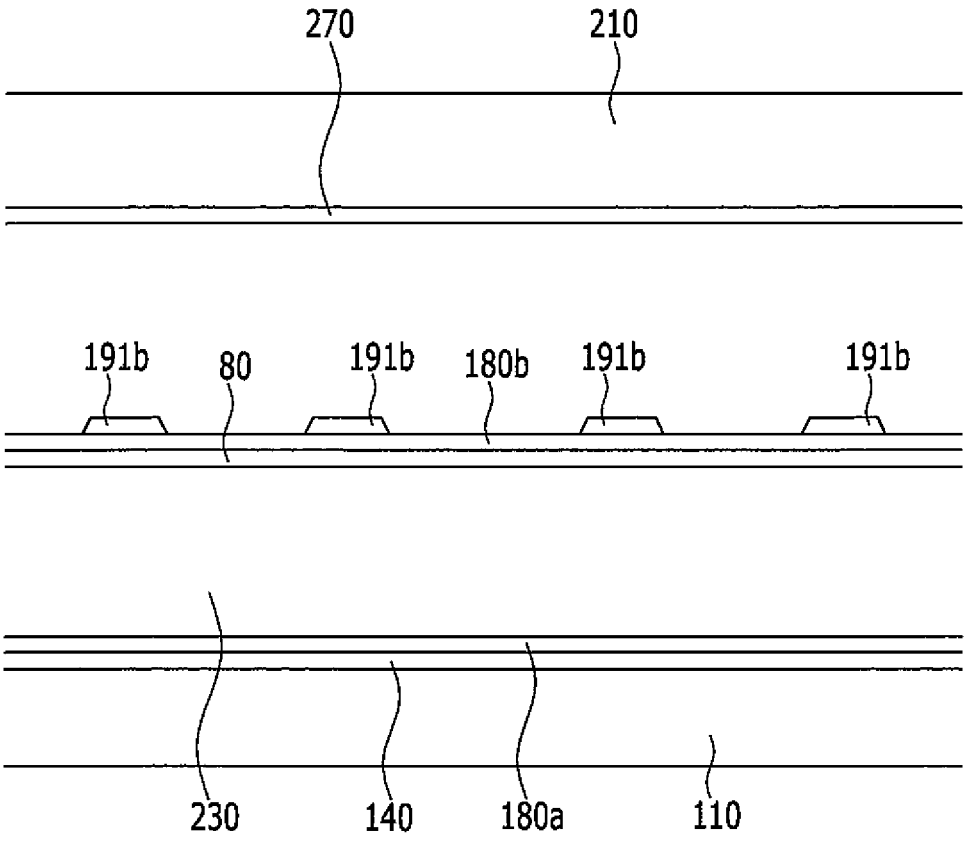
FIG. 32 shows a cross-sectional view of a liquid crystal display of FIG. 25 with respect to the line XXXII-XXXXII.

A liquid crystal display, according to another example embodiment of the present invention, will now be described with reference to FIG. 25 to FIG. 32. FIG. 25 shows a layout view of a liquid crystal display according to another example embodiment of the present invention. FIG. 26 shows a cross-sectional view of a liquid crystal display of FIG. 25 with respect to the line XXVI-XXVI. FIG. 27 shows a layout view of a first portion of a first sub-pixel electrode of a liquid crystal display of FIG. 25. FIG. 28 shows a layout view of a second portion of a first sub-pixel electrode and a second sub-pixel electrode of a liquid crystal display of FIG. 25. FIG. 29 shows a cross-sectional view of a liquid crystal display of FIG. 25 with respect to the line XXIX-XXIX. FIG. 30 shows a cross-sectional view of a liquid crystal display of FIG. 25 with respect to the line XX-XX. FIG. 31 shows a cross-sectional view of a liquid crystal display of FIG. 25 with respect to the line XXXI-XXXI. FIG. 32 shows a cross-sectional view of a liquid crystal display of FIG. 25 with respect to the line XXXII-XXXII.

Referring to FIG. 25 to FIG. 32, the liquid crystal display according to the present example embodiment is similar to the liquid crystal display according to the example embodiment described with reference to FIG. 1 to FIG. 8. A detailed description of elements having similar reference numerals may not be provided.

In a manner similar to the liquid crystal display according to the example embodiment described with reference to FIG. 1 to FIG. 8, in the liquid crystal display according to the present example embodiment, one pixel area includes a first region (R1) in which a second sub-region 191*a*2 of a first sub-pixel electrode 191*a* is provided, a second region (R2) in which part of a first sub-region 191*a*1 of the first sub-pixel electrode 191*a* overlaps a second branch electrodes 195 of a second sub-pixel electrode 191*b*, a third region (R3) in which an extension 192*b* of the second sub-pixel electrode 191*b* is provided, and a fourth region (R4) in which a plurality of third branch electrodes 196 of the second sub-pixel electrode 191*b* are provided. The first region (R1), the second region (R2), the third region (R3), and the fourth region (R4) each have four sub-regions.

An area of the second region (R2) may be substantially twice the area of the first region (R1), and a sum of the areas of the third region (R3) and the fourth region (R4) may be substantially three times the area of the second region (R2). Further, an area of the extension 192*b* of the second sub-pixel electrode 191*b* corresponding to the third region (R3) may be about 5% to about 60% of the area of the second sub-pixel electrode 191*b*.

The first region (R1) of one pixel area of the liquid crystal display, according to the present example embodiment, is provided on the first display panel 100, and the second sub-region 191*a*2 of the first sub-pixel electrode 191*a* coupled to the first extension 193 of the first sub-region 191*a*1 of the first sub-pixel electrode 191*a* and the common electrode 270 provided on the second display panel 200 generate an electric field. The second sub-region 191*a*2 of the first sub-pixel electrode 191*a* includes a cross stem and a plurality of first branch electrodes 194 extending in four different directions. The first branch electrodes 194 may be slanted by about 40 to about 45 degrees with respect to the gate line 121. The liquid crystal molecules of the liquid crystal layer 3 provided in the first region (R1) lie in four different directions by a fringe field occurring on edges of the first branch electrodes 194. In further detail, a horizontal component of the fringe field induced by a plurality of first branch electrodes 194 is substantially orthogonal to (e.g., orthogonal to) sides of the first branch electrodes 194 such that the liquid crystal molecules are influenced by the fringe field caused by respective sides of the first branch electrodes 194 and are inclined in a direction that is substantially parallel to a lengthwise direction of the first branch electrodes 194.

A plurality of second branch electrodes 195 of the second sub-pixel electrode 191*b* provided on the first display panel 100 overlap the first sub-region 191*a*1 of the first sub-pixel electrode 191*a* in the second region (R2) of one pixel area of the liquid crystal display, according to the present example embodiment. Therefore, the liquid crystal molecules of the liquid crystal layer 3 are arranged by the electric field formed between the first sub-region 191*a*1 of the first sub-pixel electrode 191*a* and the common electrode 270 together with the electric field formed between a plurality of second branch electrodes 195 of the second sub-pixel electrode 191*b* and the common electrode 270 of the second display panel 200.

Since the second branch electrodes 195 extend in a direction that is substantially parallel to a plurality of first branch electrodes 194, the liquid crystal molecules of the liquid crystal layer 3 provided in the second region (R2) lie in four different directions in a manner similar to the liquid crystal molecules of the liquid crystal layer 3 provided in the first region (R1).

The liquid crystal molecules of the liquid crystal layer 3 are arranged by the electric field formed between the extension 192*b* of the second sub-pixel electrode 191*b* provided on the first display panel 100 and the common electrode 270 provided on the second display panel 200 in the third region (R3) of one pixel area of the liquid crystal display, according to the present example embodiment.

A plurality of third branch electrodes 196 of the second sub-pixel electrode 191*b* provided on the first display panel 100 generate an electric field together with the common electrode 270 provided on the second display panel 200 in the fourth region (R4) of one pixel area of the liquid crystal display, according to the present example embodiment. Since the third branch electrodes 196 extend in a direction that is substantially parallel to a plurality of first branch electrodes 194 and a plurality of second branch electrodes 195, the liquid crystal molecules of the liquid crystal layer 3 provided in the fourth region (R4) lie in four different directions in a manner similar to the liquid crystal molecules of the liquid crystal layer 3 provided in the first region (R1) and the second region (R2).

As described above, the extension 192*b* of the second sub-pixel electrode 191*b* has a plate shape to increase transmittance of the liquid crystal display and make an intensity of the electric field formed between the extension 192*b* in the plate shape and the common electrode 270 greater than an intensity of the electric field formed between the third branch electrodes 196 and the common electrode 270.

Differing from the liquid crystal display according to the example embodiment shown in FIG. 1 to FIG. 8, the liquid crystal display according to the present example embodiment includes a third cutout 93 formed by removing a part of the edge of the extension 192*b* of the second sub-pixel electrode 191*b*. As described above, the liquid crystal molecules of the liquid crystal layer 3 corresponding to an edge surrounding the extension 192*b* of the second sub-pixel electrode 191*b* may be inclined in a direction that is substantially orthogonal to (e.g., orthogonal to) the edge of the extension 192*b* due to the influence of a fringe field applied in a direction that is substantially orthogonal to the edge of the extension 192*b*, and the transmittance of the liquid crystal display may be accordingly deteriorated (e.g., reduced). However, in the liquid crystal display, according to the present example embodiment, the third cutout 93 is formed on the edge of the extension 192*b* of the second sub-pixel electrode 191*b* to reduce the influence of the fringe field formed on the edge of the extension 192*b* of the second sub-pixel electrode 191*b* and to reduce (e.g., to prevent) the liquid crystal molecules corresponding to the edge of the extension 192*b* from being inclined in the direction that is substantially orthogonal to the edge of the extension 192*b*, thereby decreasing reduction of transmittance.

As described above, the second voltage applied to the second sub-pixel electrode 191*b* is less than the first voltage applied to the first sub-pixel electrode 191*a*.

Therefore, the intensity of the electric field applied to the liquid crystal layer provided in the first region (R1) is the greatest, and the intensity of the electric field applied to the liquid crystal layer provided in the fourth region (R4) is the least. The second region (R2) is influenced by the electric field of the first sub-pixel electrode 191*a* provided at a lower side of the second sub-pixel electrode 191*b* such that the intensity of the electric field applied to the liquid crystal layer provided in the second region (R2) is less than the intensity of the electric field applied to the liquid crystal layer provided in the first region (R1) and is greater than the intensity of the electric field applied to the liquid crystal layer provided in the third region (R3) and the fourth region (R4). Regarding the third region (R3) and the fourth region (R4) to which the voltage with the same level is applied, the intensity of the electric field of the third region (R3) having the extension 192*b* in the plate shape is greater than the intensity of the electric field of the fourth region (R4) having a plurality of third branch electrodes 196. Therefore, the intensity of the electric field applied to the liquid crystal layer 3 is reduced in the first region (R1), the second region (R2), the third region (R3), and the fourth region (R4), and the reduction of the intensity of the electric field in the enumerated four regions (R1 to R4) increases in the order of enumeration of the four regions.

In the liquid crystal display, according to the example embodiment of the present invention, one pixel area is divided into four regions with different intensities of the electric field applied to the liquid crystal layer 3 so that the angles of the liquid crystal molecules are different in the respective regions and luminances of the respective regions are different. When one pixel area is divided into four regions with different values of luminance as described, the change of transmittance induced by gray levels is gently controlled and the steep change of transmittance according to the change of gray levels on the side in the low gray level and the high gray level is reduced (e.g., prevented) such that the lateral visibility approach the front visibility and that the liquid crystal display expresses accurate grays in the low gray level and the high gray level.

Also, the first region (R1), the second region (R2), the third region (R3), and the fourth region (R4) have a small gap between adjacent regions, so one pixel area is divided into a plurality of regions with different intensities of the electric field applied to the liquid crystal layer 3 and a reduction of transmittance of the pixel area may be reduced (e.g., prevented).

Further, the liquid crystal molecules of the liquid crystal layer 3 corresponding to the third region (R3) may be controlled to be in a direction substantially parallel to the liquid crystal molecules of the liquid crystal layer 3 corresponding to the adjacent region by forming the area of the extension 192*b* in the plate shape forming the third region (R3) to be about 5% to about 60% of the entire area of the second sub-pixel electrode 191*b*.

Many characteristics of the liquid crystal displays according to the example embodiment described with reference to FIG. 1 to FIG. 8, FIG. 9 to FIG. 16, and FIG. 17 to FIG. 24 are applicable to the liquid crystal display according to the present example embodiment.

Figure 33:
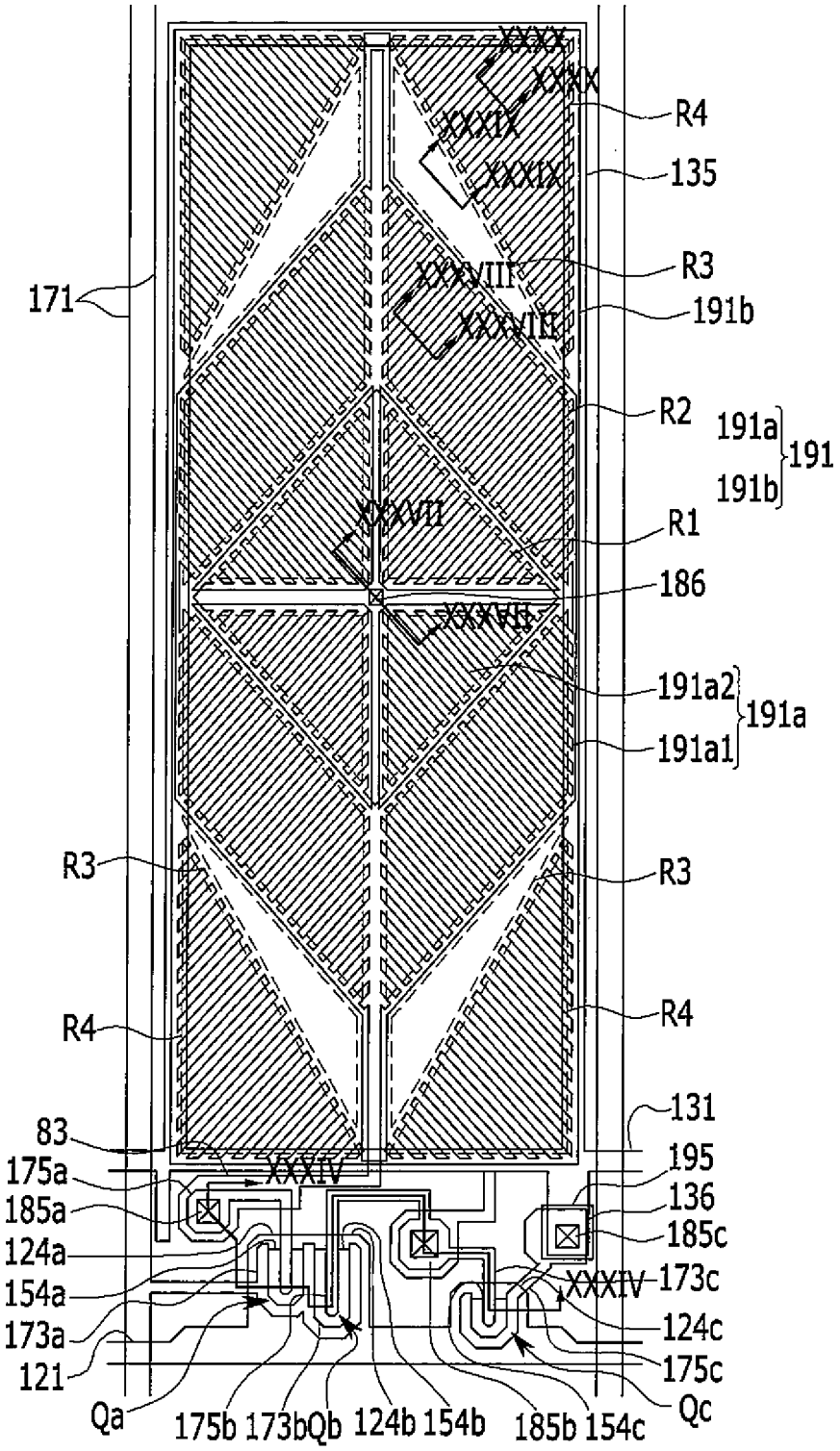
FIG. 33 shows a layout view of a liquid crystal display, according to another example embodiment of the present invention.
Figure 34:
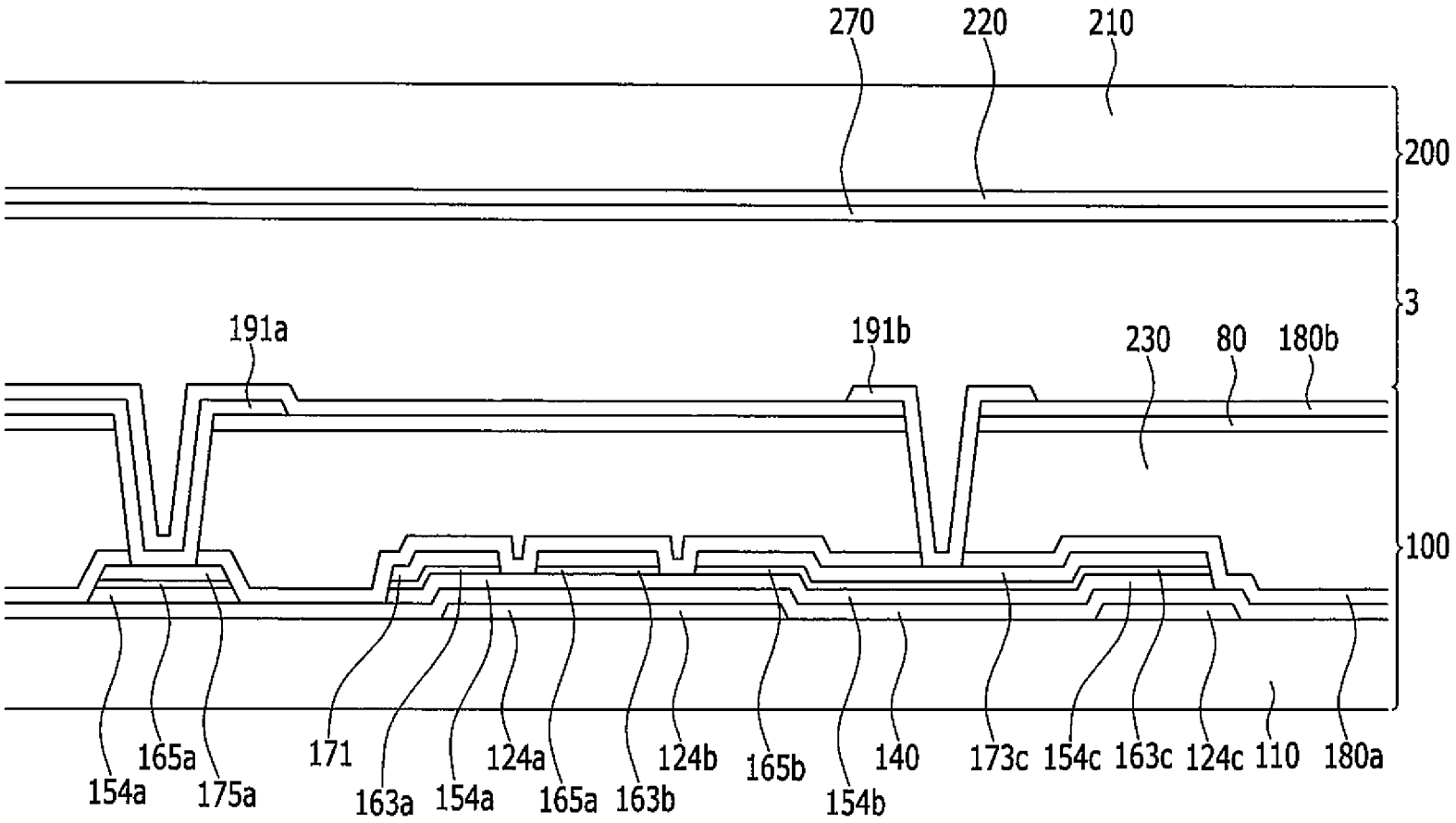
FIG. 34 shows a cross-sectional view of a liquid crystal display of FIG. 33 with respect to the line XXXIV-XXXIV.
Figure 35:
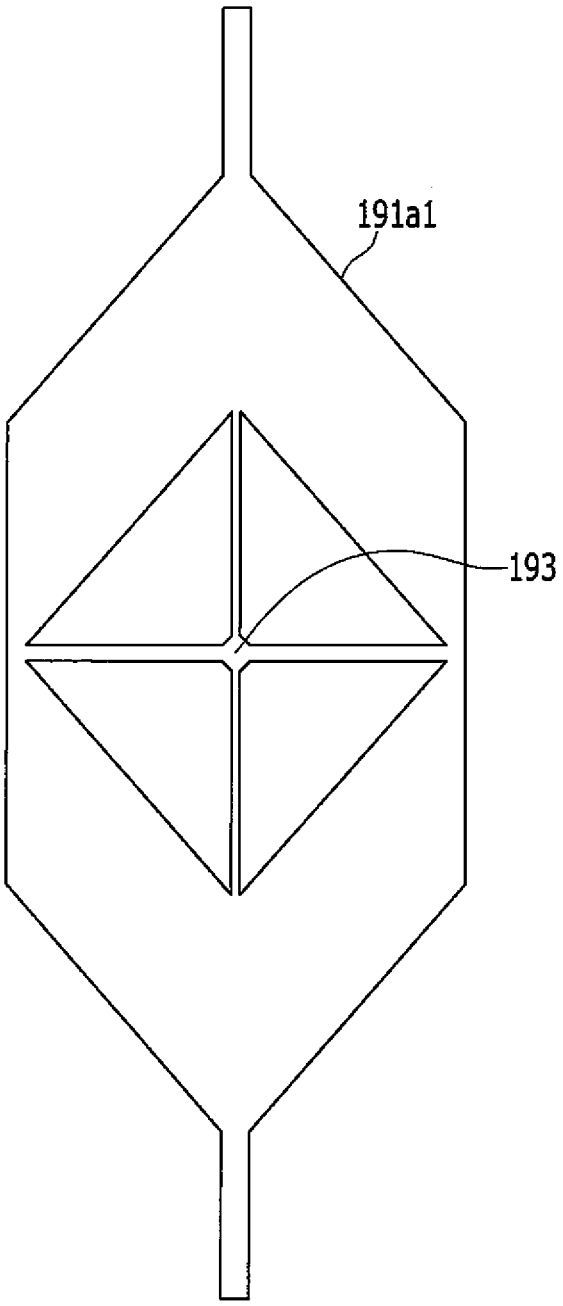
FIG. 35 shows a layout view of a first portion of a first sub-pixel electrode of a liquid crystal display of FIG. 33.
Figure 36:
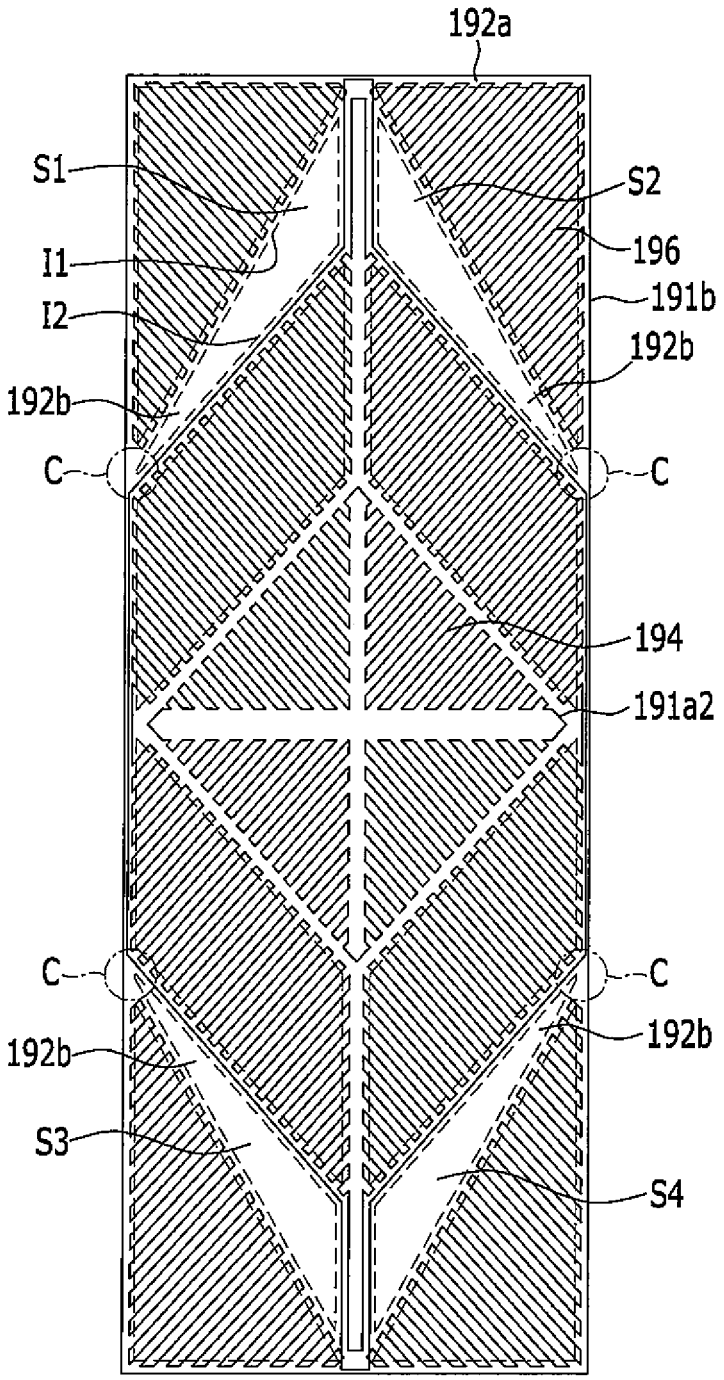
FIG. 36 shows a layout view of a second portion of a first sub-pixel electrode and a second sub-pixel electrode of a liquid crystal display of FIG. 33.
Figure 37:
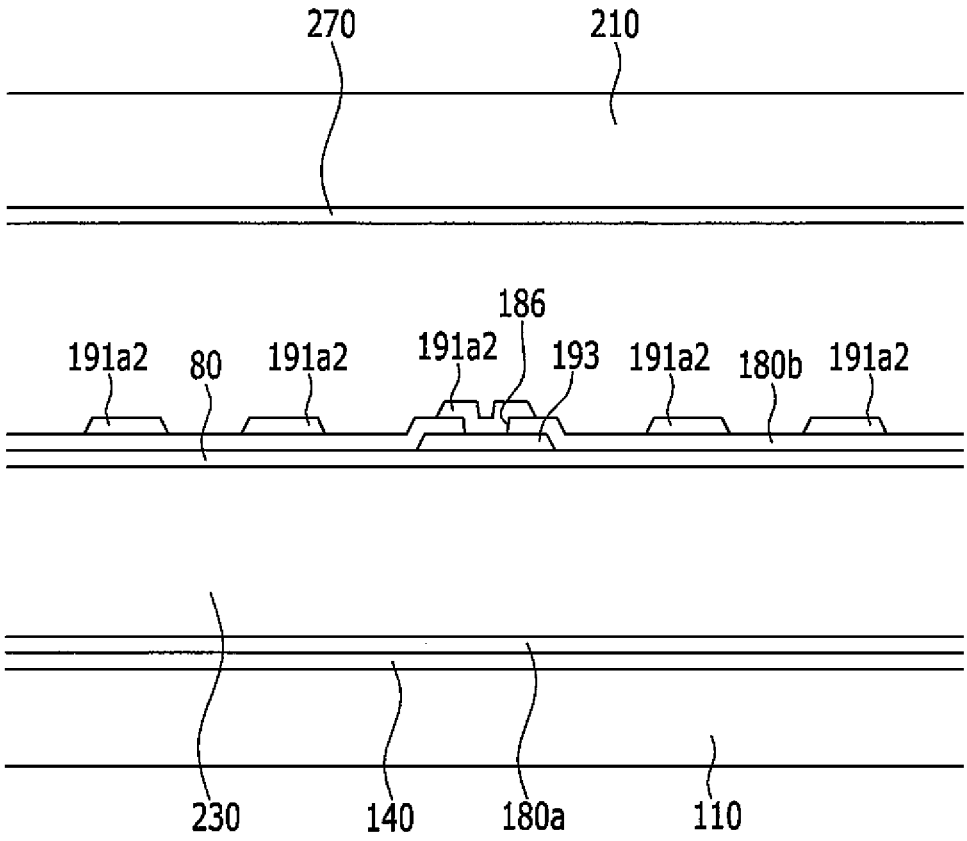
FIG. 37 shows a cross-sectional view of a liquid crystal display of FIG. 33 with respect to the line XXXVII-XXXVII.
Figure 38:
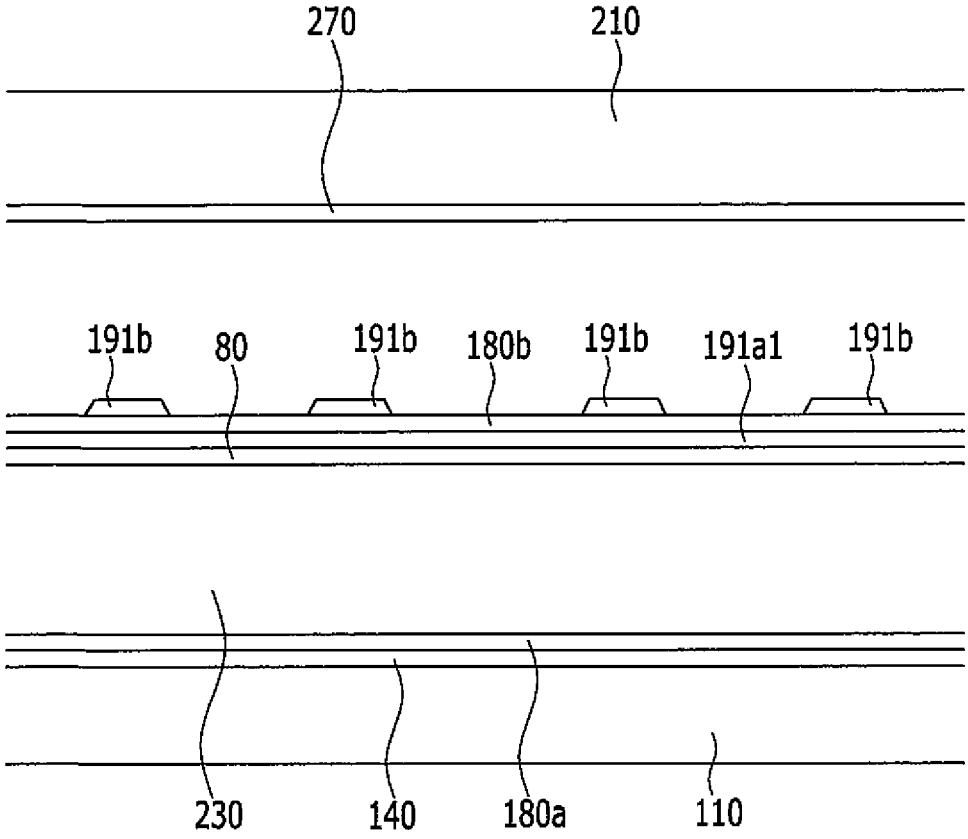
FIG. 38 shows a cross-sectional view of a liquid crystal display of FIG. 33 with respect to the line XXXVIII-XXXVIII.
Figure 39:
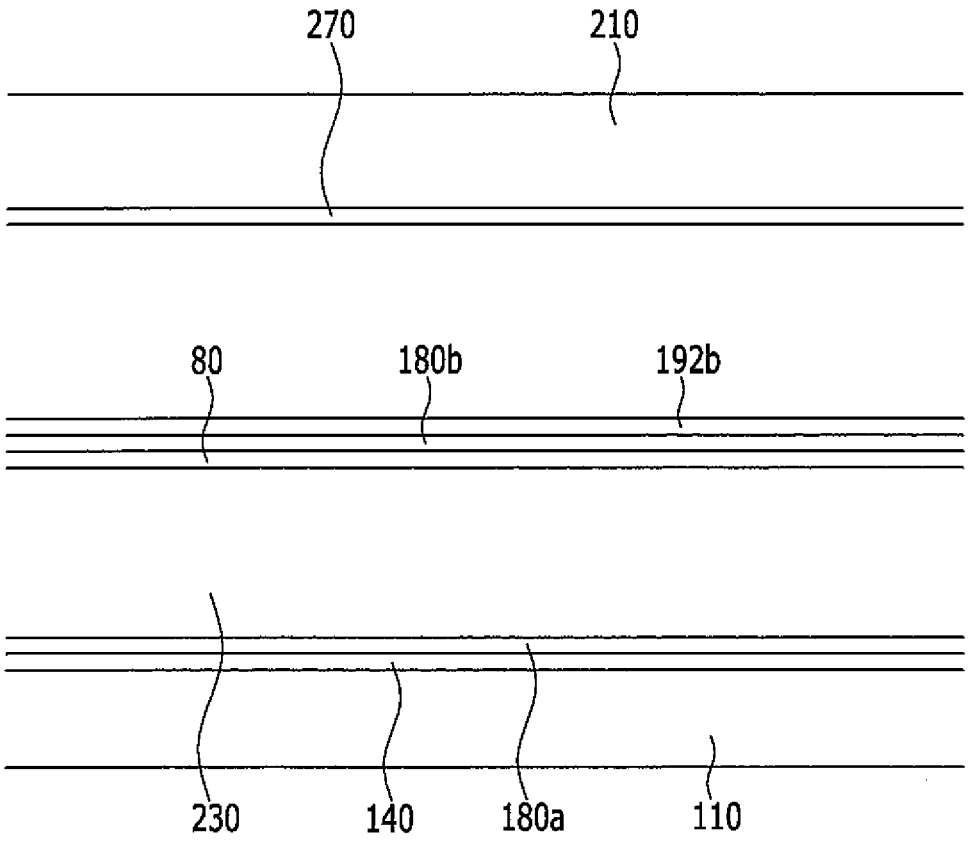
FIG. 39 shows a cross-sectional view of a liquid crystal display of FIG. 33 with respect to the line XXXIX-XXXIX.
Figure 40:
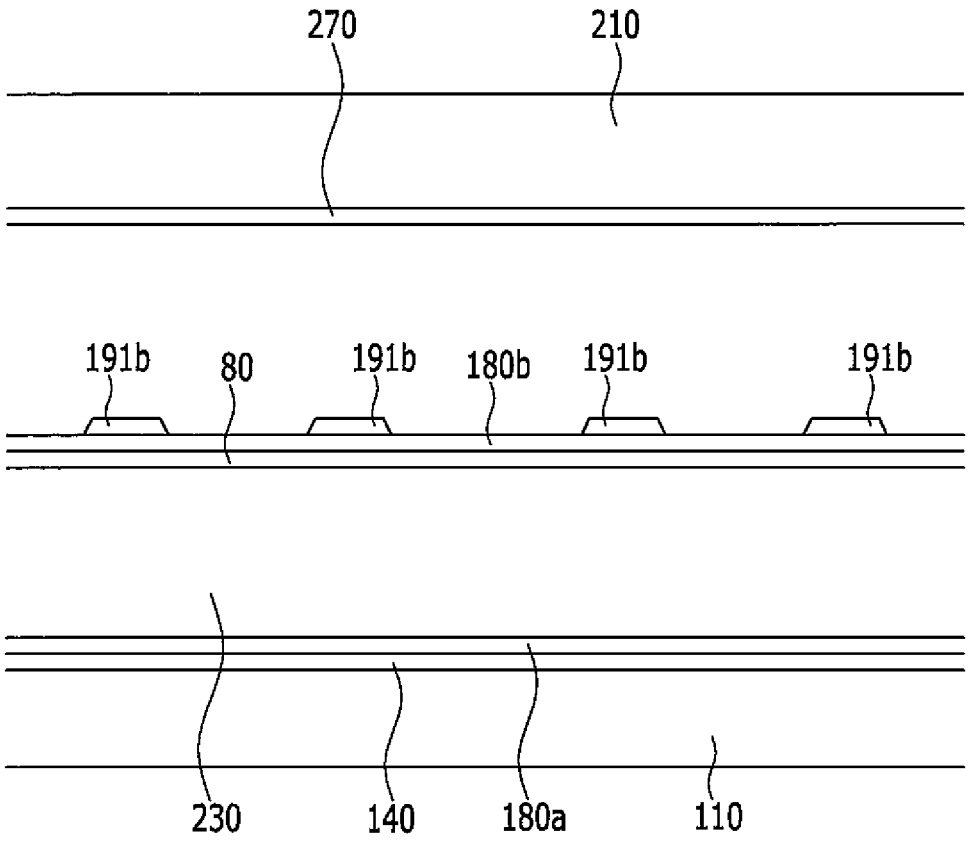
FIG. 40 shows a cross-sectional view of a liquid crystal display of FIG. 33 with respect to the line XL-XL.

A liquid crystal display according to another example embodiment of the present invention will now be described with reference to FIG. 33 to FIG. 40. FIG. 33 shows a layout view of a liquid crystal display according to another example embodiment of the present invention. FIG. 34 shows a cross-sectional view of a liquid crystal display of FIG. 33 with respect to the line XXXIV-XXXIV. FIG. 35 shows a layout view of a first portion of a first sub-pixel electrode of a liquid crystal display of FIG. 33. FIG. 36 shows a layout view of a second portion of a first sub-pixel electrode and a second sub-pixel electrode of a liquid crystal display of FIG. 33. FIG. 37 shows a cross-sectional view of a liquid crystal display of FIG. 33 with respect to the line XXXVII-XXXVII. FIG. 38 shows a cross-sectional view of a liquid crystal display of FIG. 33 with respect to the line XXXVIII-XXXVIII. FIG. 39 shows a cross-sectional view of a liquid crystal display of FIG. 33 with respect to the line XXXIX-XXXIX. FIG. 40 shows a cross-sectional view of a liquid crystal display of FIG. 33 with respect to the line XL-XL.

Referring to FIG. 33 to FIG. 40, the liquid crystal display according to the present example embodiment is similar to the liquid crystal display according to the example embodiment described with reference to FIG. 1 to FIG. 8. A detailed description of elements having similar reference numerals may not be provided.

In a manner similar to the liquid crystal display according to the example embodiment described with reference to FIG. 1 to FIG. 8, regarding the liquid crystal display according to the present example embodiment, one pixel area includes a first region (R1) in which a second sub-region 191*a*2 of a first sub-pixel electrode 191*a* is provided, a second region (R2) in which part of a first sub-region 191*a*1 of the first sub-pixel electrode 191*a* overlaps a second branch electrodes 195 of a second sub-pixel electrode 191*b*, a third region (R3) in which an extension 192*b* of the second sub-pixel electrode 191*b* is provided, and a fourth region (R4) in which a plurality of third branch electrodes 196 of the second sub-pixel electrode 191*b* are provided. The first region (R1), the second region (R2), the third region (R3), and the fourth region (R4) each have four sub-regions.

An area of the second region (R2) may be substantially twice the area of the first region (R1), and a sum of the areas of the third region (R3) and the fourth region (R4) may be substantially three times the area of the second region (R2). Further, an area of the extension 192*b* of the second sub-pixel electrode 191*b* corresponding to the third region (R3) may be about 5% to about 60% of the area of the second sub-pixel electrode 191*b*.

The first region (R1) of one pixel area of the liquid crystal display according to the present example embodiment is provided on the first display panel 100, and the second sub-region 191*a*2 of the first sub-pixel electrode 191*a* coupled to the first extension 193 of the first sub-region 191*a*1 of the first sub-pixel electrode 191*a* and the common electrode 270 provided on the second display panel 200 generate an electric field. The second sub-region 191*a*2 of the first sub-pixel electrode 191*a* includes a cross stem and a plurality of first branch electrodes 194 extending in four different directions. The first branch electrodes 194 may be slanted by about 40 to about 45 degrees with respect to the gate line 121. The liquid crystal molecules of the liquid crystal layer 3 provided in the first region (R1) lie in four different directions by a fringe field occurring on edges of the first branch electrodes 194. In further detail, a horizontal component of the fringe field induced by a plurality of first branch electrodes 194 is substantially orthogonal to (e.g., orthogonal to) sides of the first branch electrodes 194 such that the liquid crystal molecules are influenced by the fringe field caused by respective sides of the first branch electrodes 194 and are inclined in a direction that is substantially parallel to a lengthwise direction of the first branch electrodes 194.

A plurality of second branch electrodes 195 of the second sub-pixel electrode 191*b* provided on the first display panel 100 overlap the first sub-region 191*a*1 of the first sub-pixel electrode 191*a* in the second region (R2) of one pixel area of the liquid crystal display according to the present example embodiment. Therefore, the liquid crystal molecules of the liquid crystal layer 3 are arranged by the electric field formed between the first sub-region 191*a*1 of the first sub-pixel electrode 191*a* and the common electrode 270 together with the electric field formed between a plurality of second branch electrodes 195 of the second sub-pixel electrode 191*b* and the common electrode 270 of the second display panel 200.

Since the second branch electrodes 195 extend in a direction that is substantially parallel to a plurality of first branch electrodes 194, the liquid crystal molecules of the liquid crystal layer 3 provided in the second region (R2) lie in four different directions in a manner similar to the liquid crystal molecules of the liquid crystal layer 3 provided in the first region (R1).

The liquid crystal molecules of the liquid crystal layer 3 are arranged by the electric field formed between the extension 192*b* of the second sub-pixel electrode 191*b* provided on the first display panel 100 and the common electrode 270 provided on the second display panel 200 in the third region (R3) of one pixel area of the liquid crystal display according to the present example embodiment.

A plurality of third branch electrodes 196 of the second sub-pixel electrode 191*b* provided on the first display panel 100 generate an electric field together with the common electrode 270 provided on the second display panel 200 in the fourth region (R4) of one pixel area of the liquid crystal display according to the present example embodiment. Since the third branch electrodes 196 extend in a direction that is substantially parallel to a plurality of first branch electrodes 194 and a plurality of second branch electrodes 195, the liquid crystal molecules of the liquid crystal layer 3 provided in the fourth region (R4) lie in four different directions in a manner similar to the liquid crystal molecules of the liquid crystal layer 3 provided in the first region (R1) and the second region (R2).

As described above, the extension 192*b* of the second sub-pixel electrode 191*b* has a plate shape to increase transmittance of the liquid crystal display and make an intensity of the electric field formed between the extension 192*b* in the plate shape and the common electrode 270 greater than an intensity of the electric field formed between the third branch electrodes 196 and the common electrode 270.

Referring to FIG. 36, differing from the liquid crystal display according to the example embodiment shown in FIG. 1 to FIG. 8, the extension 192*b* of the second sub-pixel electrode 191*b* of the liquid crystal display according to the present example embodiment has a form of four gathered triangles, not a form of four gathered parallelograms. Therefore, the extension 192*b* of the second sub-pixel electrode 191*b* corresponding to the edge of the pixel area corresponds to an apex (C) of a triangle so an area occupied by the extension 192*b* of the second sub-pixel electrode 191*b* on the edge of the pixel area becomes very small. The area taken up by the extension 192*b* of the second sub-pixel electrode 191*b* on the edge of the pixel area is formed to be narrow to minimize the influence of the fringe field applied to the edge of the extension 192*b* and decrease a reduction of transmittance of the liquid crystal display that may occur on the edge of the extension 192*b*. The area of the extension 192*b* of the second sub-pixel electrode 191*b* is lessened, compared to the liquid crystal display according to the above-described example embodiments, by changing the form of the extension 192*b* of the second sub-pixel electrode 191*b*. In further detail, regarding the liquid crystal display according to the present example embodiment, the area of the extension 192*b* of the second sub-pixel electrode 191*b* corresponding to the third region (R3) may be about 5% to about 30% of the entire area of the second sub-pixel electrode 191*b*.

As described above, the second voltage applied to the second sub-pixel electrode 191*b* is less than the first voltage applied to the first sub-pixel electrode 191*a*.

Therefore, the intensity of the electric field applied to the liquid crystal layer provided in the first region (R1) is the greatest, and the intensity of the electric field applied to the liquid crystal layer provided in the fourth region (R4) is the least. The second region (R2) is influenced by the electric field of the first sub-pixel electrode 191*a* provided at a lower side of the second sub-pixel electrode 191*b* such that the intensity of the electric field applied to the liquid crystal layer provided in the second region (R2) is less than the intensity of the electric field applied to the liquid crystal layer provided in the first region (R1) and is greater than the intensity of the electric field applied to the liquid crystal layer provided in the third region (R3) and the fourth region (R4). Regarding the third region (R3) and the fourth region (R4) to which the voltage with the same level is applied, the intensity of the electric field of the third region (R3) having the extension 192*b* in the plate shape is greater than the intensity of the electric field of the fourth region (R4) having a plurality of third branch electrodes 196. Therefore, the intensity of the electric field applied to the liquid crystal layer 3 is reduced in the first region (R1), the second region (R2), the third region (R3), and the fourth region (R4), and the reduction of the intensity of the electric field in the enumerated four regions (R1 to R4) increases in the order of enumeration of the four regions.

Regarding the liquid crystal display according to the example embodiment of the present invention, one pixel area is divided into four regions with different intensities of the electric field applied to the liquid crystal layer 3 so that the angles of the liquid crystal molecules are different in the respective regions and luminances of the respective regions are different. When one pixel area is divided into four regions with different values of luminance as described, the change of transmittance induced by gray levels is gently controlled and the steep change of transmittance according to the change of gray levels on the side in the low gray level and the high gray level is reduced (e.g., prevented) such that the lateral visibility approach the front visibility and that the liquid crystal display expresses accurate grays in the low gray level and the high gray level.

Also, the first region (R1), the second region (R2), the third region (R3), and the fourth region (R4) have a small gap between adjacent regions, so one pixel area is divided into a plurality of regions with different intensities of the electric field applied to the liquid crystal layer 3 and a reduction of transmittance of the pixel area may be reduced (e.g., prevented).

Further, the liquid crystal molecules of the liquid crystal layer 3 corresponding to the third region (R3) may be controlled to be in a direction substantially parallel to the liquid crystal molecules of the liquid crystal layer 3 corresponding to the adjacent region by forming the area of the extension 192*b* in the plate shape forming the third region (R3) to be about 5% to about 60% of the entire area of the second sub-pixel electrode 191*b*.

Many characteristics of the liquid crystal displays according to the example embodiment described with reference to FIG. 1 to FIG. 8, FIG. 9 to FIG. 16, FIG. 17 to FIG. 24, and FIG. 25 to FIG. 32 are applicable to the liquid crystal display according to the present example embodiment.

Figure 41:
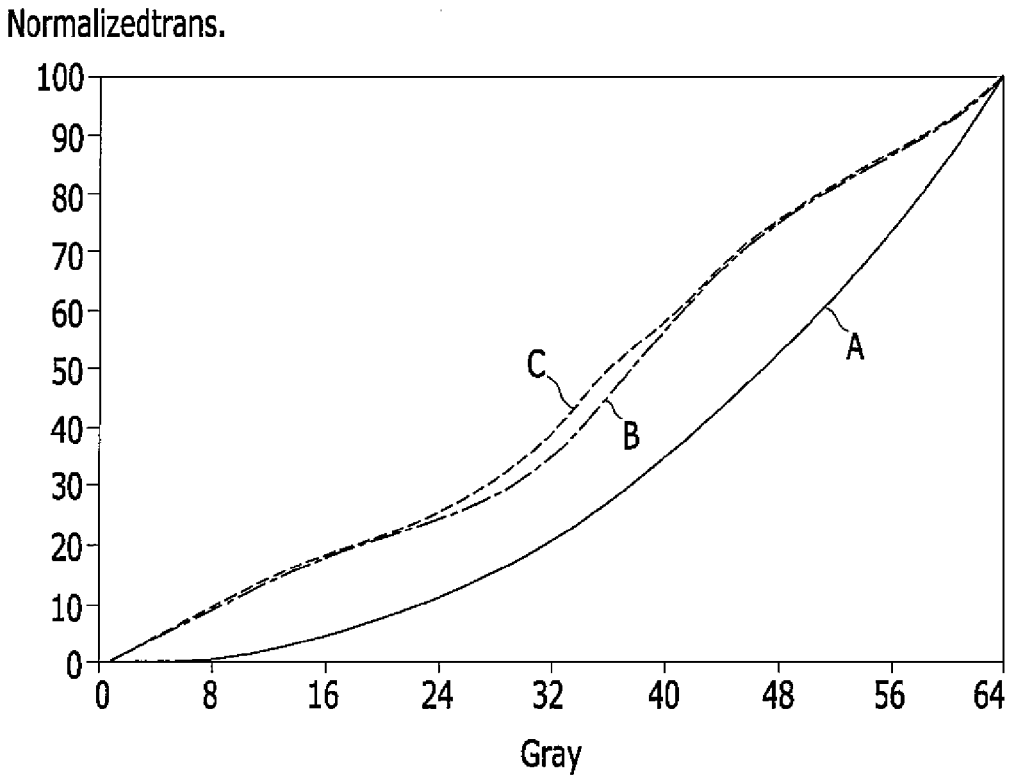
FIG. 41 shows a graph of transmittance per gray level, according to an experimental example of the present invention.

Referring to FIG. 41, an experimental example of the present invention will now be described. FIG. 41 shows a graph of transmittance per gray level, according to an experimental example of the present invention.

In the present experimental example, transmittance for respective gray levels on the side of the liquid crystal display is measured for a first case of dividing one pixel area into an area in which a high pixel electrode is formed, an area in which a high pixel electrode overlaps a low pixel electrode configured with a branch electrode, and an area in which a low pixel electrode configured with a branch electrode is formed, and a second case of dividing one pixel area into four areas in a manner similar to the liquid crystal display, according to the example embodiment of the present invention, and the measured data are compared with transmittance results for respective gray levels at the front of the liquid crystal display.

FIG. 41 shows a per-gray transmittance curve (A) at the front, a per-gray transmittance curve (B) on the side for the first case, and a per-gray transmittance curve (C) on the side for the second case.

Referring to FIG. 41, when the curve (A) is compared with the curve (B) substantially in gray levels 25 to 32, the curve (B) shows lower transmittance with respect to the change of gray levels than the curve (A). Therefore, the first case may deteriorate (e.g., reduce) displaying quality for the gray levels 25 to 32 since the change of transmittance induced by the change of gray levels is not clearly indicated.

When the curve (A), the curve (B), and the curve (C) are compared substantially in gray levels 25 to 32, the curve (A) and the curve (C) show changes of transmittance for respective gray levels with most similar slopes. That is, it is found in the second case in which one pixel area is divided into four areas in a manner similar to the liquid crystal display according to the present example embodiment, the transmittance is well changed according to the change of gray levels in a manner similar to the change of transmittance for respective gray levels, differing from the first case. Therefore, when one pixel area is divided into four areas in a manner similar to the liquid crystal display according to the present example embodiment, it is found that deterioration of (e.g., reduction of) display quality that may occur because of unclear changes of transmittance caused by the change of gray levels may be reduced (e.g., prevented).

Figure 42:
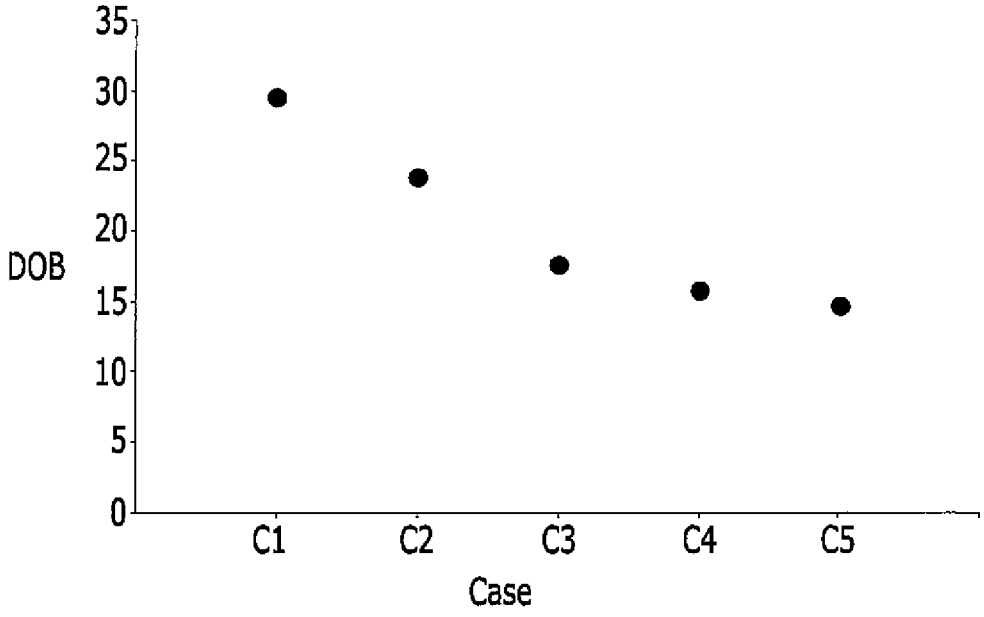
FIG. 42 shows a graph of slope change states of a curve of transmittance per gray level, according to an experimental example of the present invention.

Referring to FIG. 42, another experimental example of the present invention will now be described. FIG. 42 shows a graph of slope change states of a curve of transmittance per gray level, according to an experimental example of the present invention.

Transmittance for respective gray levels on the side of the liquid crystal display is measured in the present experimental example for a first case of dividing one pixel area into two areas, a second case of dividing one pixel area into an area in which a high pixel electrode is formed, an area in which a high pixel electrode overlaps a low pixel electrode configured with a branch electrode, and an area in which a low pixel electrode configured with a branch electrode is formed, and a third case of dividing one pixel area into four areas in a manner similar to the liquid crystal display, according to the example embodiment of the present invention, and a slope of a position having the greatest change of transmittance according to the change of gray levels, that is, the ratio of the change of transmittance induced by the change of gray levels, is relatively compared, and corresponding values are shown in FIG. 42.

The third case changes the area ratio of the extension of the second sub-pixel electrode to the area of the second sub-pixel electrode to measure three different cases.

Referring to FIG. 42, C1 is a value for the first case, C2 is a value for the second case, C3 to C5 are values for the third case, and in more detail, C3 shows the case in which the ratio of the area of the extension of the second sub-pixel electrode to the area of the second sub-pixel electrode is about 12%, C4 shows the case in which the ratio of the area of the extension of the second sub-pixel electrode to the area of the second sub-pixel electrode is about 17%, and C5 shows the case in which the ratio of the area of the extension of the second sub-pixel electrode to the area of the second sub-pixel electrode is about 22%.

DOB shows a relative value of a slope of the position having the greatest change of transmittance according to the change of gray levels, and as the value becomes greater, the change of transmittance becomes greater than the change of gray levels, so it shows that the change of transmittance caused by the change of gray levels is excessively great for a gray level (e.g., a predetermined gray level) and the change of transmittance caused by the change of gray levels is relatively less for remaining gray levels. DOB shows that it is difficult to express the change of gray level, and the display quality is deteriorated (e.g., reduced), when the change of transmittance is great according to the change of gray level for a gray level (e.g., a predetermined gray level) and the same is not great for the remaining gray levels. When the value of DOB is less, it shows that the change of transmittance is not great for gray levels (e.g., predetermined gray levels), that transmittance is gently changed when all gray levels are changed, that the change of gray levels may be clearly indicated, and that display quality deterioration (e.g., reduction) is less.

Compared to the first case and the second case, in the third case for dividing one pixel area into four areas in a manner similar to the liquid crystal display according to the example embodiment of the present invention, it is found that transmittance is gently changed according to the change of gray levels to generate less deterioration of (e.g., reduction of) display quality, and when the ratio of the area of the extension of the second sub-pixel electrode to the area of the second sub-pixel electrode is about 5% to about 60% in a manner similar to the liquid crystal display according to the example embodiment of the present invention, it is found that transmittance is gently changed according to the change of gray levels to generate less deterioration of (e.g., reduction of) display quality.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A liquid crystal display comprising:

a first substrate;

a first sub-pixel electrode on the first substrate and configured to receive a first voltage;

a second sub-pixel electrode on the first substrate and configured to receive a second voltage;

an insulating layer between the first sub-pixel electrode and the second sub-pixel electrode;

a second substrate facing the first substrate; and a common electrode on the second substrate, wherein the first sub-pixel electrode comprises a first sub-region below the insulating layer and a second sub-region above the insulating layer, wherein the second sub-region of the first sub-pixel electrode comprises a plurality of first branch electrodes, wherein the second sub-pixel electrode is above the insulating layer and comprises:

a third sub-region comprising a plurality of second branch electrodes extending substantially in parallel with the first branch electrodes, a fourth sub-region coupled to the third sub-region and having a planar form in a planar shape, and a fifth sub-region coupled to the fourth sub-region and comprising a plurality of third branch electrodes extending substantially in parallel with the first branch electrodes and the second branch electrodes, and wherein a difference between the first voltage and a common voltage is greater than a difference between the second voltage and the common voltage.

2. The liquid crystal display of claim 1, wherein a ratio of an area of the fourth sub-region taken over that of an entire area of the second sub-pixel electrode is about 9% to about 30%.

3. The liquid crystal display of claim 2, wherein a part of the first sub-region of the first sub-pixel electrode overlaps the third sub-region of the second sub-pixel electrode with the insulating layer therebetween.

4. The liquid crystal display of claim 3, wherein the first sub-region of the first sub-pixel electrode and the second sub-region are coupled to each other through a contact opening in the insulating layer.

5. The liquid crystal display of claim 2, wherein the second sub-pixel electrode surrounds the second sub-region of the first sub-pixel electrode, and wherein the fourth sub-region of the second sub-pixel electrode has a planar form comprising four parallelograms.

6. The liquid crystal display of claim 2, wherein the fourth sub-region of the second sub-pixel electrode comprises a cutout on an edge of the fourth sub-region that is near an edge data line of the fourth sub-region.

7. The liquid crystal display of claim 6, wherein the cutout is in a direction that is substantially parallel to the third branch electrode.

8. The liquid crystal display of claim 6, wherein the cutout is substantially parallel to the edge of the fourth sub-region.

9. The liquid crystal display of claim 6, wherein in the cutout, a part of the edge of the fourth sub-region is removed in parallel with the edge of the fourth sub-region.

10. The liquid crystal display of claim 2, wherein the second sub-pixel electrode surrounds the second sub-region of the first sub-pixel electrode, and the fourth sub-region of the second sub-pixel electrode has a planar form including four triangles.

11. The liquid crystal display of claim 10, wherein the fourth sub-region has a form in which an apex of the triangle is on an edge of the second sub-pixel electrode.

12. The liquid crystal display of claim 2, wherein wherein an area in which the first sub-region of the first sub-pixel electrode overlaps the third region of the second sub-pixel electrode is about twice an area of the second sub-region of the first sub-pixel electrode, and wherein a sum of areas of the fourth sub-region and the fifth sub-region of the second sub-pixel electrode is about six times an area of the second sub-region of the first sub-pixel electrode.

* * * * *